US011930930B1

(12) United States Patent
Zhao et al.

(10) Patent No.: US 11,930,930 B1
(45) Date of Patent: Mar. 19, 2024

(54) MODULAR FURNITURE ASSEMBLY

(71) Applicant: Cushy Holdings, Inc., San Diego, CA (US)

(72) Inventors: Zelong Zhao, Beijing (CN); Jun Yang, Zhejiang (CN); Yinxiang Shi, Zhejiang (CN); Simiao Jin, San Diego, CA (US)

(73) Assignee: Cushy Holdings, Inc., San Diego, CA (US)

( * ) Notice: Subject to any disclaimer, the term of this patent is extended or adjusted under 35 U.S.C. 154(b) by 0 days.

(21) Appl. No.: 18/455,606

(22) Filed: Aug. 24, 2023

(51) Int. Cl.
*A47C 13/00* (2006.01)
*A47C 7/54* (2006.01)

(52) U.S. Cl.
CPC ..... *A47C 13/005* (2013.01); *A47C 7/546* (2013.01)

(58) Field of Classification Search
CPC ..... A47C 13/005; A47C 7/546; A47C 17/04; A47C 17/34; A47C 19/005
USPC ..... 297/440.14
See application file for complete search history.

(56) References Cited

U.S. PATENT DOCUMENTS

| | | | | |
|---|---|---|---|---|
| 5,360,255 | A * | 11/1994 | Cook | A47C 1/0355 D6/335 |
| 5,630,644 | A * | 5/1997 | LaPointe | A47C 13/005 297/411.32 |
| 2014/0062145 | A1* | 3/2014 | Iacovoni | A47B 13/021 297/135 |
| 2018/0000244 | A1* | 1/2018 | Nelson | A47C 13/005 |
| 2023/0066786 | A1* | 3/2023 | Zhao | A47C 17/34 |

* cited by examiner

*Primary Examiner* — Mark R Wendell
(74) *Attorney, Agent, or Firm* — Nixon Peabody LLP

(57) ABSTRACT

A modular furniture assembly has a modular universal base, an armrest module, and a modular recliner. The armrest is modularly coupled to one side of the modular universal base and includes an armrest member, a stepped member, a base horizontal member, and a base vertical plate. The modular recliner is coupled to another side of the modular universal base, and includes a recliner base and a backrest module. The recliner base has a plurality of frames that are interconnected and mechanically attached to each other. The recliner base includes a recessed surface that forms a transverse gap within the recliner base, and a top support having a flat top surface aligned with top edges of the plurality of frames. The backrest module has two backrest sections with end plates configured to move, respectively, along the recessed surface.

20 Claims, 24 Drawing Sheets

MODULAR FURNITURE ASSEMBLY

FIELD OF THE INVENTION

The present invention relates generally to a furniture assembly, and more specifically, to modular components that interconnect to form various forms of the furniture assembly.

BACKGROUND OF THE INVENTION

A considerable number of conventional items of furniture are available in the furniture marketplace, including for example, leather, fabric, wood, and other options. Construction and assembly of a conventional item of furniture is cost and labor intensive. Because overall design is a prime driver of sales, development, and production of furniture items, industrialized and standardized production and delivery thereof is limited and efficiency is extremely low. Present modular furniture designs are limited to the disassembly of the furniture itself, which has no practical significance. Moreover, the hardware connectors used in existing modular furniture suffer from deficiencies and low practicability such that modular furniture does not appear to a significant extent in the furniture marketplace.

For example, one conventional sofa that is misleadingly touted as a "modular" sofa includes at least two matching sofa monomers having insertion holes. During construction of the furniture assembly, the sofa monomers are positioned adjacent and a connecting nail is driven into the insertion holes to connect the monomers together. After the monomers are connected and the sofa is assembled, the monomers are difficult to disconnect. In fact, disassembly is difficult, being prone to damaging the monomers and/or requiring tools or excessive force. Additionally, it is necessary to set insertion holes on the sofa monomers, which requires additional effort and tools. As a result, processing, delivery, and installation costs for such a conventional sofa are high, rendering this type of sofa to be in true form a non-modular sofa. Accordingly, such a non-modular sofa is not conducive to modular commercial utility or consumer appeal. The present disclosure provides a solution for these and other problems.

SUMMARY OF THE INVENTION

The term embodiment and like terms, e.g., implementation, configuration, aspect, example, and option, are intended to refer broadly to all of the subject matter of this disclosure and the claims below. Statements containing these terms should be understood not to limit the subject matter described herein or to limit the meaning or scope of the claims below. Embodiments of the present disclosure covered herein are defined by the claims below, not this summary. This summary is a high-level overview of various aspects of the disclosure and introduces some of the concepts that are further described in the Detailed Description section below. This summary is not intended to identify key or essential features of the claimed subject matter. This summary is also not intended to be used in isolation to determine the scope of the claimed subject matter. The subject matter should be understood by reference to appropriate portions of the entire specification of this disclosure, any or all drawings, and each claim.

According to certain aspects of the present disclosure, a modular furniture assembly includes a modular universal base, an armrest module, and a modular recliner. The armrest module is modularly coupled to one side of the modular universal base, and includes an armrest member, a stepped member, a base horizontal member, and a base vertical plate. The armrest member is configured to receive a user arm when a user is in a seated position. The stepped member is configured to receive a user head when the user is in a lying down position, the stepped member being generally horizontal to and lower than the armrest member. The base horizontal member is generally parallel to and lower than the stepped member. The base vertical plate covers an empty internal space between the base horizontal member and a bottom end of the armrest module. The modular recliner is coupled to another side of the modular universal base, and has a recliner base and a backrest module. The recliner base has a plurality of frames and a top support. The frames are interconnected and mechanically attached to each other. The fames include a front frame member, a right frame member a left frame member, and a rear frame member. Each of the left and right frame members has a recessed surface that forms a transverse gap within the recliner base. The top support has a flat top surface aligned with top edges of the plurality of frames. The top support has at least two sandwiched frame layers having a top frame layer and a bottom frame layer. The at least two sandwiched frame layers have an internal space for reducing weight of the modular recliner. The backrest module has two backrest sections, each of the backrest sections having an end plate and an inner plate. Each end plate has a bottom surface at an inclined angle that is configured to move along a respective recessed surface, the end plate being structurally connected to the inner plate via a plurality of first connecting beams. The inner plates are structurally connected to each other via a plurality of second connecting beams.

According to some features of the above aspects, the recessed surface is near the frame rear member.

According to other features of the above aspects, the recessed surface is near the frame rear member.

According to yet other features of the above aspects, the recessed surface has a generally arcuate shape.

According to yet other features of the above aspects, the recessed surface extends inward starting at a top edge of the right frame member.

According to yet other features of the above aspects, the recessed surface extends between the top edge of the right frame member and partially towards a lower edge of the right frame member.

According to yet other features of the above aspects, the recliner base further has a pair of frame structures that includes a left frame structure and a right frame structure. The left frame structure is directly attached to the left frame member, and the right frame structure is directly attached to the right frame member.

According to yet other features of the above aspects, each frame structure of the pair of frame structures having a top member connected to a bottom member via an internal member.

According to yet other features of the above aspects, a pair of transverse members attach the internal member of each structure to the other internal member.

According to yet other features of the above aspects, a connector is attached directly to the modular recliner and the modular universal base, the connector coupling the modular recliner and the modular universal base achieving a secure, toolless modular attachment between the modular universal base and the modular recliner.

According to yet other features of the above aspects, the connector is a pivotable connector, the pivotable connector including a first vertical mounting plate attached to the modular universal base and a second vertical mounting plate attached to the modular recliner, the pivotable connector further including a first pivotable plate coupled to the first vertical mounting plate and a second pivotable plate coupled to the second vertical mounting plate.

According to other aspects of the present disclosure, a modular furniture assembly includes an armrest module, an insertion connector, a modular recliner, and a receiving connector. The armrest module has an armrest member and a stepped member. The armrest member is configured to receive a user arm when a user is in a seated position. The stepped member is configured to receive a user head when the user is in a lying down position, the stepped member being generally horizontal to and lower than the armrest member. The insertion connector is attached directly to the armrest module, the insertion connector having bent end. The modular recliner has a recliner base and a backrest module. The recliner base has a plurality of frames and a top support. The frames are interconnected and mechanically attached to each other, and include a front frame member, a right frame member, a left frame member, and a rear frame member. Each of the left and right frame members has a recessed surface that forms a transverse gap within the recliner base. The top support has a flat top surface aligned with top edges of the plurality of frames, the top support having at least two sandwiched frame layers including a top frame layer and a bottom frame layer. The backrest module has two backrest sections, each of the backrest sections having an end plate and an inner plate. Each end plate has a bottom surface at an inclined angle that is configured to move along a respective recessed surface. The receiving connector is attached directly to the modular recliner. The receiving connector has a mounting space in which the bent end of the insertion connector is received. Mounting the receiving connector with the insertion connector achieves a secure, toolless modular attachment between the armrest module and the modular recliner.

According to some features of the above aspects, the insertion connector has an insertion plate that is connected to an attachment plate via a connecting side, the bent end being a free end extending from the insertion plate.

According to other features of the above aspects, the bent end is angled away from a plane of the attachment plate.

According to yet other features of the above aspects, the insertion plate is offset from and parallel to the attachment plate.

According to yet other features of the above aspects, the offset between the insertion plate and the attachment plate is based on a length dimension of the connecting side.

According to yet other features of the above aspects, the receiving connector has two sides connected via a retaining side, each of the two sides having a mounting surface that is directly attached to the modular recliner.

According to yet other features of the above aspects, the retaining side has a c-shaped profile relative to the mounting surface of the two sides.

According to yet other features of the above aspects, each of the two sides has two connector attachment holes.

According to yet other features of the above aspects, the receiving connector is attached directly to either the left frame member or the right frame member. The c-shaped profile forms the mounting space between the retaining side and the one of either the left frame member or the right frame member to which the receiving connector is attached.

According to yet other features of the above aspects, the armrest module further has a base vertical plate that positioned generally perpendicular to and below the stepped member, the insertion connector being attached directly to the base horizontal member.

The above summary is not intended to represent each embodiment or every aspect of the present disclosure. Rather, the foregoing summary merely provides an example of some of the novel aspects and features set forth herein. The above features and advantages, and other features and advantages of the present disclosure, will be readily apparent from the following detailed description of representative embodiments and modes for carrying out the present invention, when taken in connection with the accompanying drawings and the appended claims. Additional aspects of the disclosure will be apparent to those of ordinary skill in the art in view of the detailed description of various embodiments, which is made with reference to the drawings, a brief description of which is provided below.

BRIEF DESCRIPTION OF THE DRAWINGS

The disclosure, and its advantages and drawings, will be better understood from the following description of representative embodiments together with reference to the accompanying drawings. These drawings depict only representative embodiments, and are therefore not to be considered as limitations on the scope of the various embodiments or claims.

DETAILED DESCRIPTION

Figure 1:
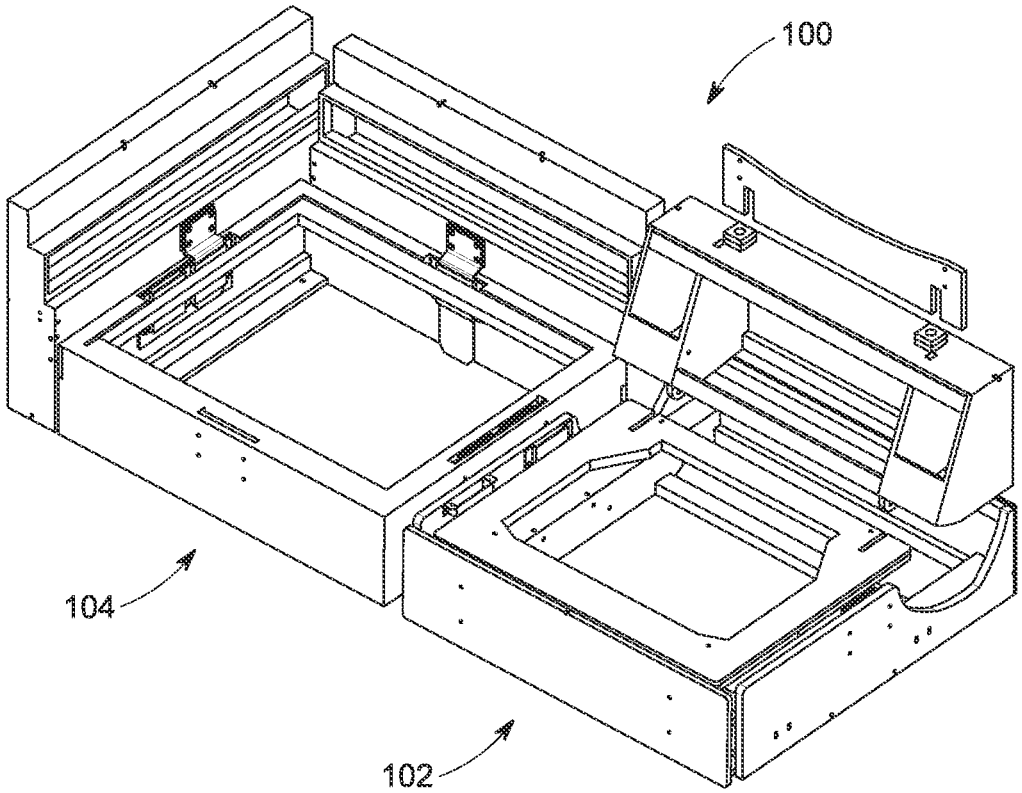
FIG. 1 is a perspective view of a modular furniture assembly with a modular recliner and a modular universal base, according to certain aspects of the present disclosure.

Various embodiments are described with reference to the attached figures, where like reference numerals are used throughout the figures to designate similar or equivalent elements. The figures are not necessarily drawn to scale and are provided merely to illustrate aspects and features of the present disclosure. Numerous specific details, relationships, and methods are set forth to provide a full understanding of certain aspects and features of the present disclosure, although one having ordinary skill in the relevant art will recognize that these aspects and features can be practiced without one or more of the specific details, with other relationships, or with other methods. In some instances, well-known structures or operations are not shown in detail for illustrative purposes. The various embodiments disclosed herein are not necessarily limited by the illustrated ordering of acts or events, as some acts may occur in different orders and/or concurrently with other acts or events. Furthermore, not all illustrated acts or events are necessarily required to implement certain aspects and features of the present disclosure.

For purposes of the present detailed description, unless specifically disclaimed, and where appropriate, the singular includes the plural and vice versa. The word "including" means "including without limitation." Moreover, words of approximation, such as "about," "almost," "substantially," "approximately," and the like, can be used herein to mean "at," "near," "nearly at," "within 3-5% of," "within acceptable manufacturing tolerances of," or any logical combination thereof. Similarly, terms "vertical" or "horizontal" are intended to additionally include "within 3-5% of" a vertical or horizontal orientation, respectively. Additionally, words of direction, such as "top," "bottom," "left," "right," "above," and "below" are intended to relate to the equivalent direction as depicted in a reference illustration; as understood contextually from the object(s) or element(s) being referenced, such as from a commonly used position for the object(s) or element(s); or as otherwise described herein.

Referring to FIG. 1, a modular furniture assembly 100 includes two modular adjacent components that are configured to securely lock with each other. According to one example, the furniture assembly 100 is in the form of a sofa. The securely locking is achieved with modular assembly that allows quick, easy, and toolless assembly and/or disassembly. In this illustration, the furniture assembly 100 includes a modular recliner 102 and a modular universal base 104.

In other examples, the furniture assembly 100 includes other combinations of two or more modular components, the modular components being any of the modular recliner 102 and the modular universal base 104. For example, in an alternative combination the furniture assembly 100 includes a modular recliner 102 that is adjacent to and securely locked with another modular recliner 102 (instead of the illustrated modular universal base 104).

In yet another example, the furniture assembly 100 includes a modular recliner 102 that is adjacent to and securely locked with a modular universal base 104, which is adjacent to and securely locked with another modular recliner 102. Thus, in this example, the furniture assembly includes three components—two modular recliners 102 along the edges, with a modular universal base 104 in-between.

Figure 2:
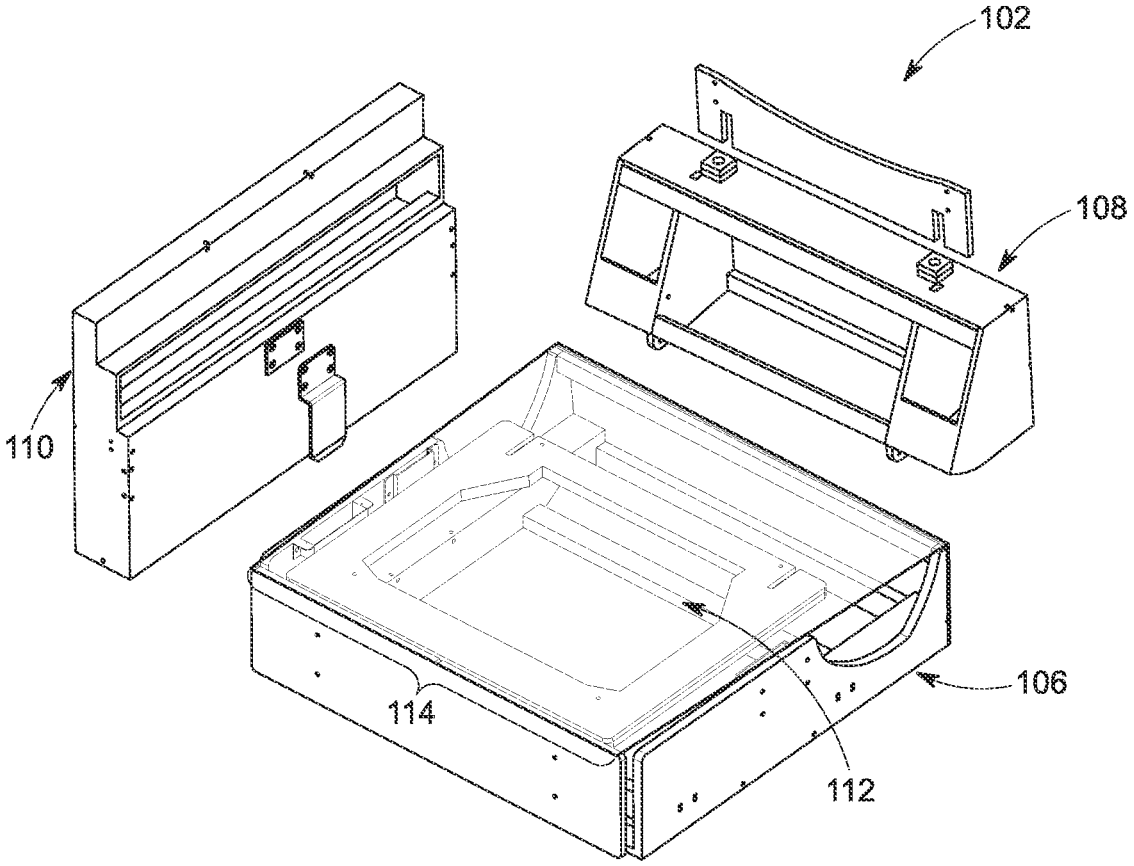
FIG. 2 is an exploded perspective view of the modular recliner illustrated in FIG. 1.

Referring to FIG. 2, the modular recliner 102 has a recliner base 106, a backrest module 108, and an armrest module 110. The armrest module 110 is modularly attachable to, and movable between, the modular recliner 102 (as illustrated in FIG. 2) and the modular universal base 104 (as illustrated in FIG. 1). For ease of understanding, the armrest module 110 is described below in attached form to the modular recliner 102.

The recliner base 106 has a generally flat top surface 112 for supporting a cushioning component (not illustrated). Thus, the flat top surface 112 provides the structural support for the cushioning component, which typically includes a shaped foam that offers comfort and support to a person resting on the modular recliner 102. The shaped foam includes, for example, a high density foam material.

One exemplary benefit of the flat top surface 112 is that it increases options for modularity and customization of the furniture assembly 100. While prior furniture assemblies require a recliner assembly to have an inclined (or angled) top surface, the present disclosure advantageously described the flat top surface 112 on which a variety of inclined cushioning components can be attached. In other words, the non-inclined (or non-angled) top surface 112 serves a much wider purpose in the recliner base 106 than typical, prior recliner assemblies (which are limited to the specific inclined top surface).

Yet another exemplary benefit of the flat top surface 112 is that a wider seat size is achieved. For example, according to one configuration a seat width 114 increase of about 4 inches is achieved.

Figure 3:
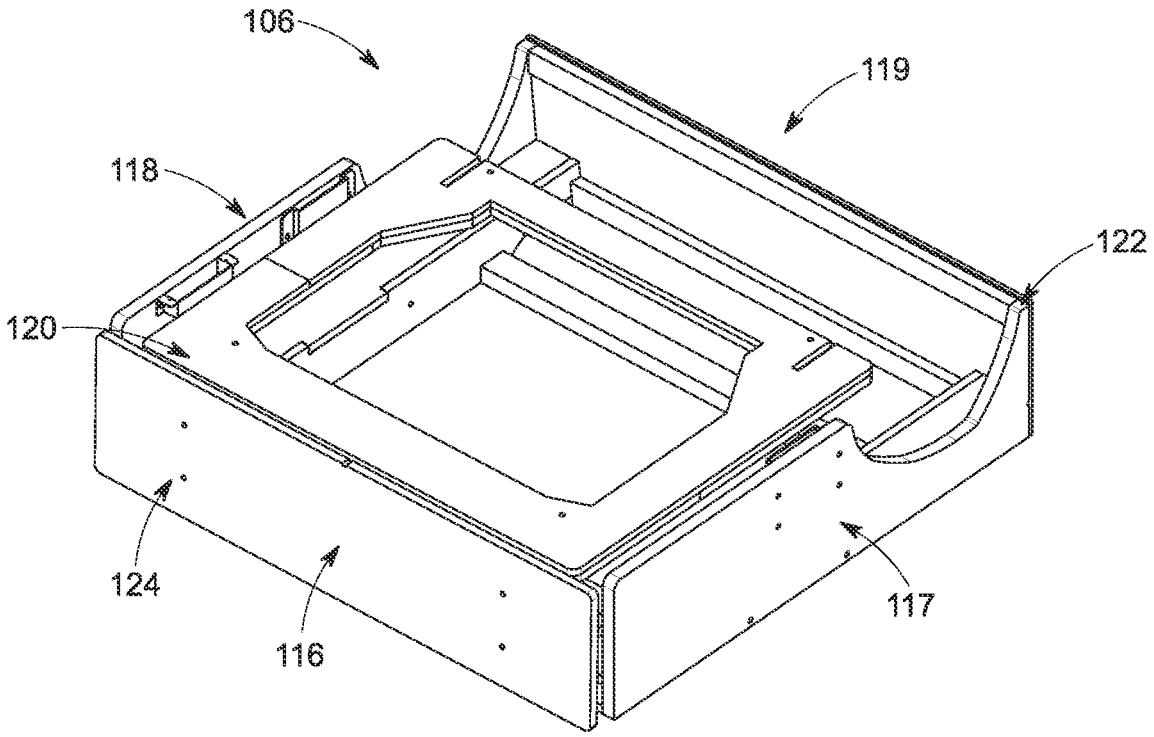
FIG. 3 is a perspective view of a recliner base of the modular recliner illustrated in FIG. 2.

Referring to FIG. 3, the recliner base 106 further has a plurality of frame members, which include a front frame member 116, a right frame member 117, a left frame member 118, and a rear frame member 119. The frame members 116-119 are interconnected and mechanically attached to each other to provide a robust structure basis.

The recliner base 106 further has a top support 120 that forms the flat top surface 112 along, and aligned, with top edges 122 of the frame members 116-119. The front frame member 116 is generally rectangular and includes front attachment holes 124 to which additional components, such as a foot rest (not shown), is attachable. According to one example, the front attachment holes 124 include an array of four holes 124, arranged in a rectangular form of two rows and two columns. The rear frame member 119 is generally rectangular, providing primarily structural integrity for the recliner base 106.

Figure 4:
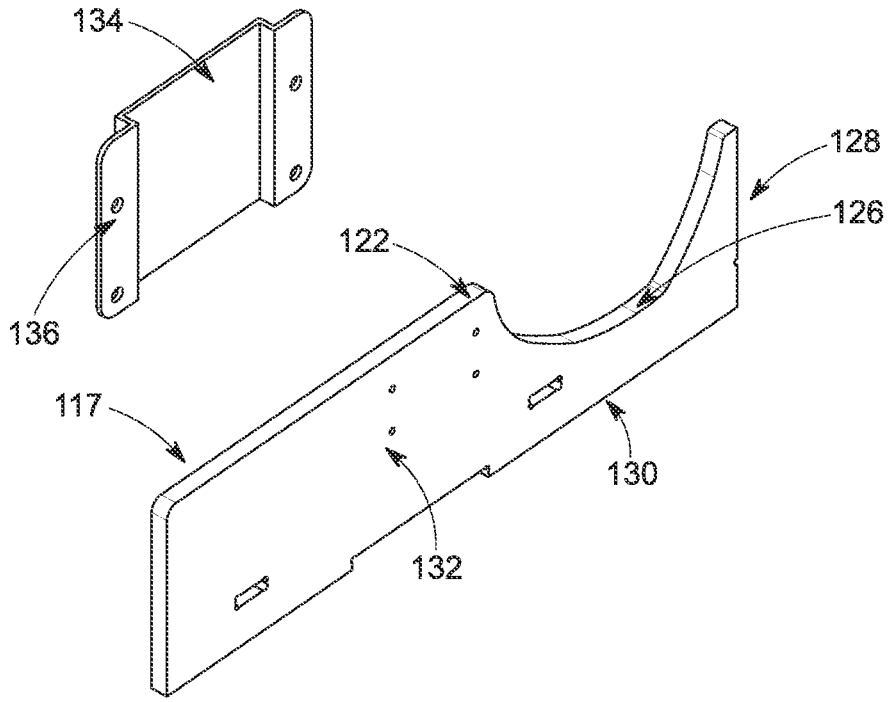
FIG. 4 is an exploded perspective view of a right frame member of the recliner base illustrated in FIG. 3 and a receiving connector, according to certain aspects of the present disclosure.

Referring to FIG. 4, the right frame member 117 has a rectangular profile with a recessed surface 126 near a rear edge 128. The recessed surface 126 has a generally arcuate shape extending inward between the top edge 122 of the right frame member 117 and, partially, towards a lower edge 130. The left frame member 118 is similar to, but not necessarily identical with, the right frame member 117. For example, the left frame member 118 also has a recessed surface that matches the recessed surface 126 of the right frame member 117.

The right frame member 117 further includes frame attachment holes 132 to which a receiving connector 134 is attached. The receiving connector 134 has connector attachment holes 136 that match, respectively, the frame attachment holes 132.

Figure 5A:
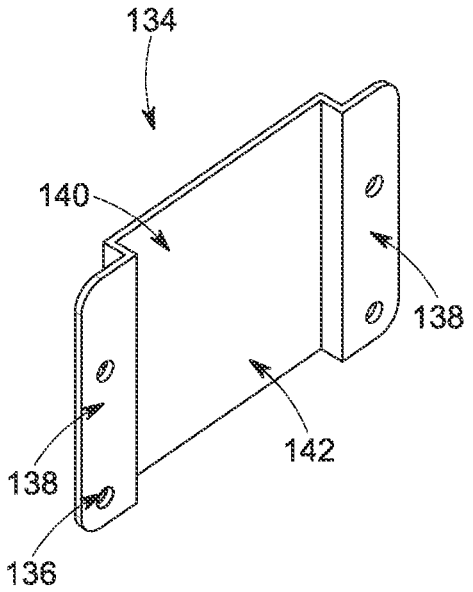
FIG. 5A is a perspective view of the receiving connector illustrated in FIG. 4.
Figure 5B:
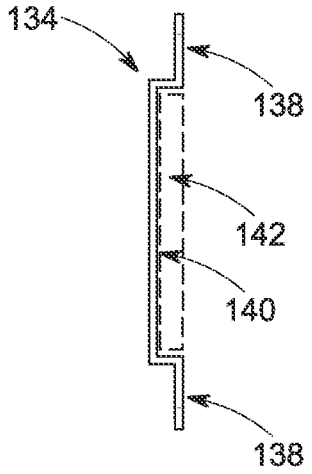
FIG. 5B is a side view of the receiving connector illustrated in FIG. 5A.

Referring to FIGS. 5A and 5B, the receiving connector 134 has a mounting surface 138 on each side, with each mounting surface 138 having two connector attachment holes 136. The mounting surfaces 138 are in direct contact with the right frame member 117 when the receiving connector 134 is mounted to the right frame member 117. The receiving connector 134 further has a retaining side 140 that has a generally c-shaped profile relative to the mounting surfaces 138. The retaining side 140 creates a mounting space 142 in which a plug-in unit is easily inserted (as described below), without use of tools, for modular attachment to the recliner base 106.

Figure 6A:
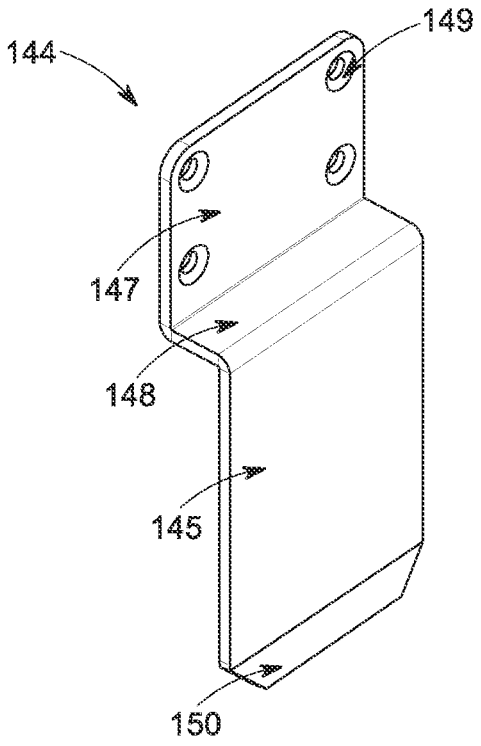
FIG. 6A is a perspective view of an insertion connector, according to certain aspects of the present disclosure.
Figure 6B:
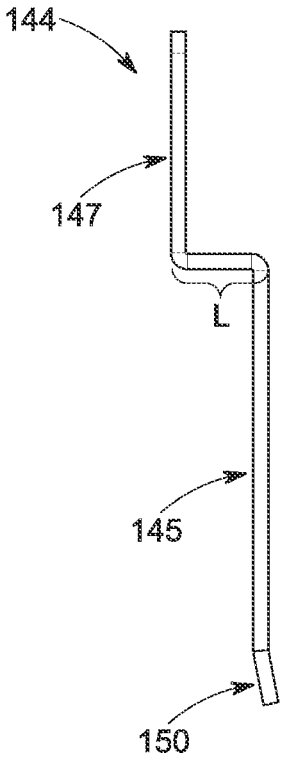
FIG. 6B is a side view of the insertion connector illustrated in FIG. 6A.

Referring to FIGS. 6A and 6B, an insertion connector 144 has an insertion plate 145 that is connected to an attachment plate 147 via a connecting side 148. The insertion plate 145 is offset from and parallel to the attachment plate 147. The offset between the plates 145, 147 is based on a length dimension L of the connecting side 148. The attachment plate 147 has a plurality of attachment holes 149 that match respective attachment holes 149 of the armrest module 110. The attachment holes 149 are arranged in a generally rectangular array with two attachment holes 149 per row and column.

The insertion plate 145 has a bent end 150, which is angled away from the plane of the attachment plate 147. The bent end 150 is beneficial at least because it provides an enhanced secured engagement when a secured, modular attachment is achieved. Thus, for example, based on the force of gravity and further based on frictional tension between the bent end 150 and the retaining side 140 of the receiving connector 134 (as disclosed below), toolless and secure engagement is achieved when attaching a plug-in furniture unit to the recliner base 106.

Figure 7B:
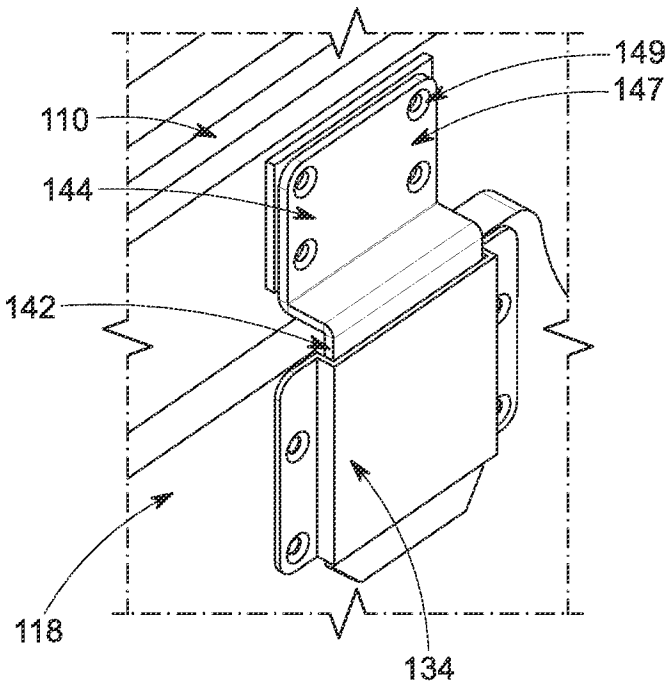
FIG. 7B is an enlarged view of the receiving and insertion connectors of FIG. 7A.
Figure 7A:
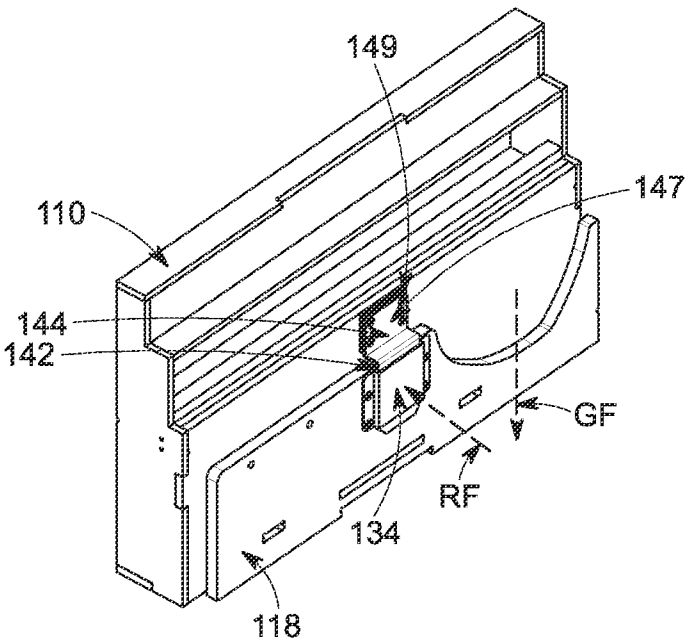
FIG. 7A is a perspective view illustrating attachment between a receiving connector and an insertion connector, according to certain aspects of the present disclosure.

Referring to FIGS. 7A and 7B, another receiving connector 134 is mounted to the left frame member 118 and receives within the mounting space 142 the insertion connector 144. The insertion plate 145 of the insertion connector 144 is mechanically fixed to the armrest module 110, which in this case is an exemplary plug-in unit. Thus, as a result of the effective and beneficial design of the receiving and insertion connectors 134, 144, the armrest module 110 is securely held in place with the recliner base 106. The secure, modular connection is based on a retaining force RF of the receiving connector 134 (including the added friction tension provided via the bent end 150) and on the force of gravity GF acting on the armrest module 110. However, disassembly is quick, easy, and toolless, requiring only a lifting force to remove the armrest module 110 from secure, but modular, connection with the recliner base 106.

Figure 8B:
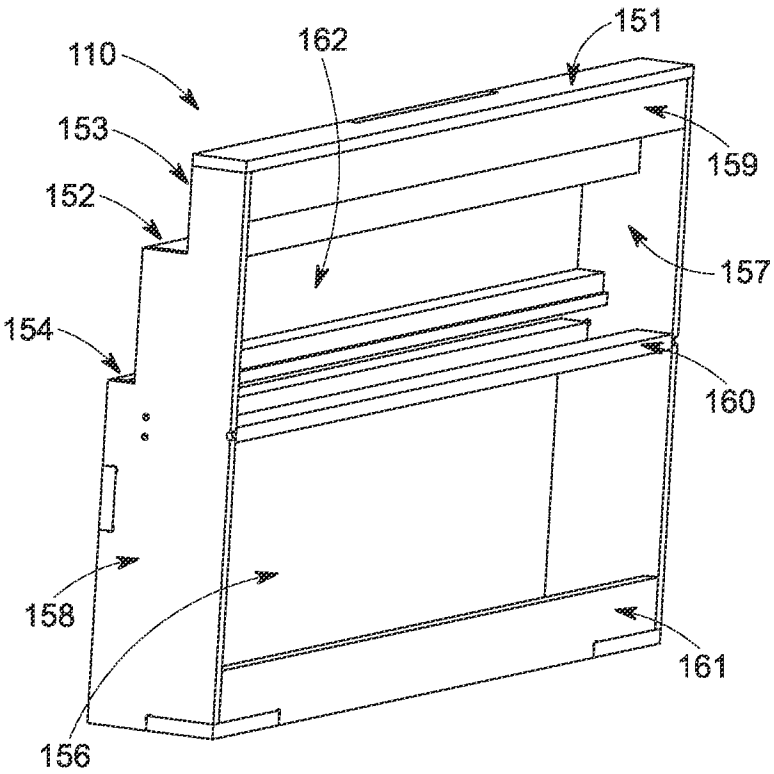
FIG. 8B is a rear perspective view of the armrest module illustrated in FIG. 8A.
Figure 8A:
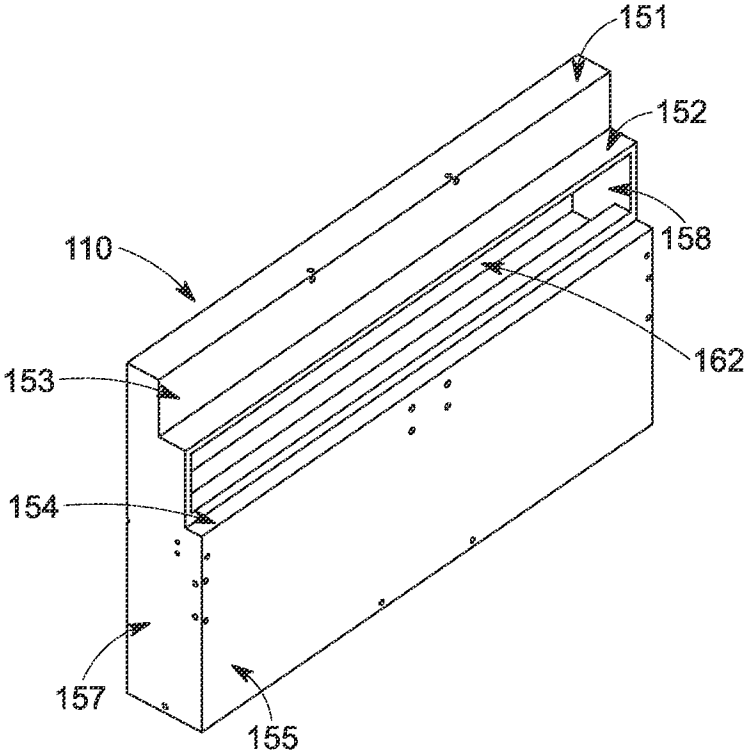
FIG. 8A is a front perspective view of an armrest module, according to certain aspects of the present disclosure.

Referring to FIGS. 8A and 8B, the armrest module 110 has a stepped design that is configured to enable resting of a user's head and arm with increased comfort. The armrest module 110 has an armrest member 151 configured to a height suitable for resting the user's arm when the user is in a seated position. The armrest module 110 further has a stepped member 152, which is lower than the armrest member 151 and which extends from a top vertical member 153. The stepped member 152 is configured to a height suitable for resting the user's head when lying down on the furniture assembly 100 (e.g., on a sofa).

The armrest module 110 further has a base horizontal member 154 that further extends inward relative to the stepped member 152. The base horizontal member 152 is generally parallel to the stepped member 152 and is generally perpendicular to a base vertical plate 155, which generally encloses an empty internal space 156 (shown in FIG. 8B). The empty internal space 156 is generally formed between a front side 157 and a rear side 158, which are generally interconnected via a plurality of structural members. The structural members include (among others) an upper rear member 159, an intermediate rear member 160, a lower rear member 161, the armrest member 151 (all of which are only shown in FIG. 8B), the stepped member 152, and the base horizontal member 154.

The structural design and configuration of the armrest module 110 is beneficial for several reasons. For example, the armrest module 110 is beneficial because it combines an optimal and efficient balance between structural integrity and low weight. The low weight is further achieved, for example, having a through empty space 162 between the base horizontal member and the stepped member 152. In another example, the armrest module 110 is beneficial because it facilitates easy, convenient, and toolless modular combination with other furniture components.

Figure 9:
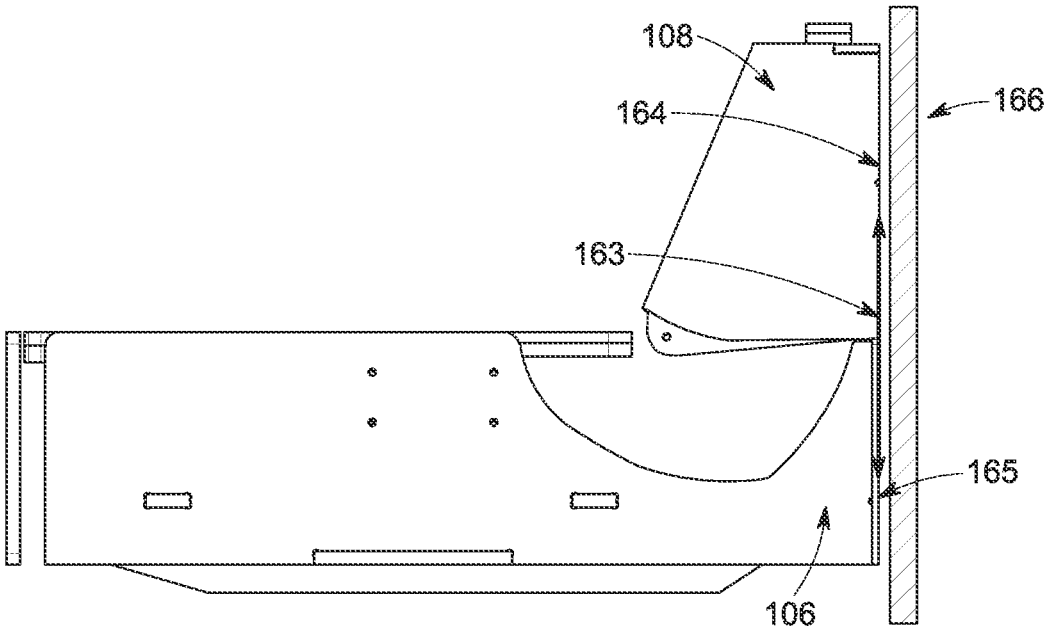
FIG. 9 is a side view of a backrest module, according to certain aspects of the present disclosure.

Referring to FIG. 9, the backrest module 108 forms a continuous and straight surface 163 with the recliner base 106 in a non-reclined position. More specifically, a back surface 164 of the backrest module 108 is aligned in a straight, continuous form with a rear surface 165 of the recliner base 106. The continuous surface 163 is beneficial at least because the lack of an offset (as typically found in prior recliners) between the two surfaces 164, 165 allows placement of the combined furniture (of the recliner base 106 and the backrest module 108) close to and/or in direct contact with a room wall 166 in which the furniture is located.

Figure 11:
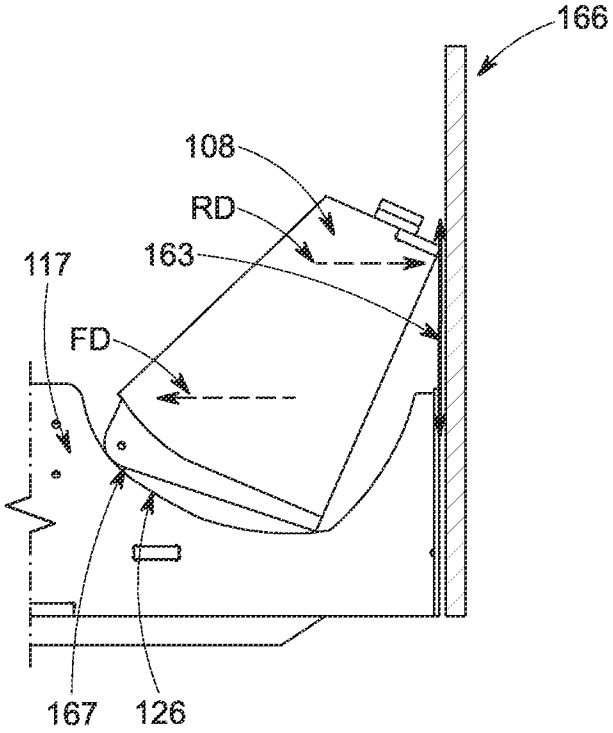
FIG. 11 is a side view illustrating a second position of the backrest module, according to certain aspects of the present disclosure.
Figure 10:
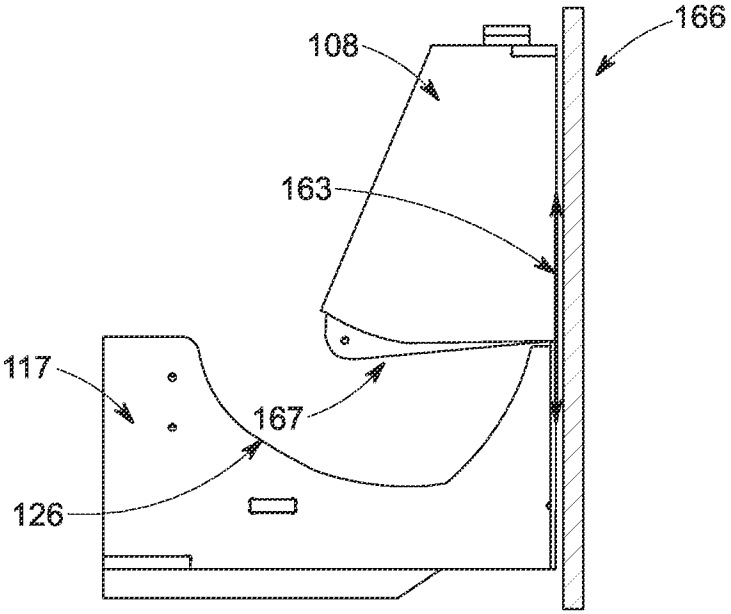
FIG. 10 is a side view illustrating a first position of the backrest module, according to certain aspects of the present disclosure.

Referring to FIGS. 10 and 11, the recessed surface 126 provides a movement guide for the backrest module 108 when moving from a non-reclined position (shown in FIG. 10) to a reclined position (shown in FIG. 11). As the backrest module 108 retracts in a clockwise direction, a bottom surface 167 of the backrest module 108 is in direct contact with and moves along the recessed surface 126 towards in a front direction FD. The interaction between the recessed surface 126 and the bottom surface 167 prevents any portion of the backrest module 108 to move in a rear direction RD towards the room wall 166.

Figure 12:
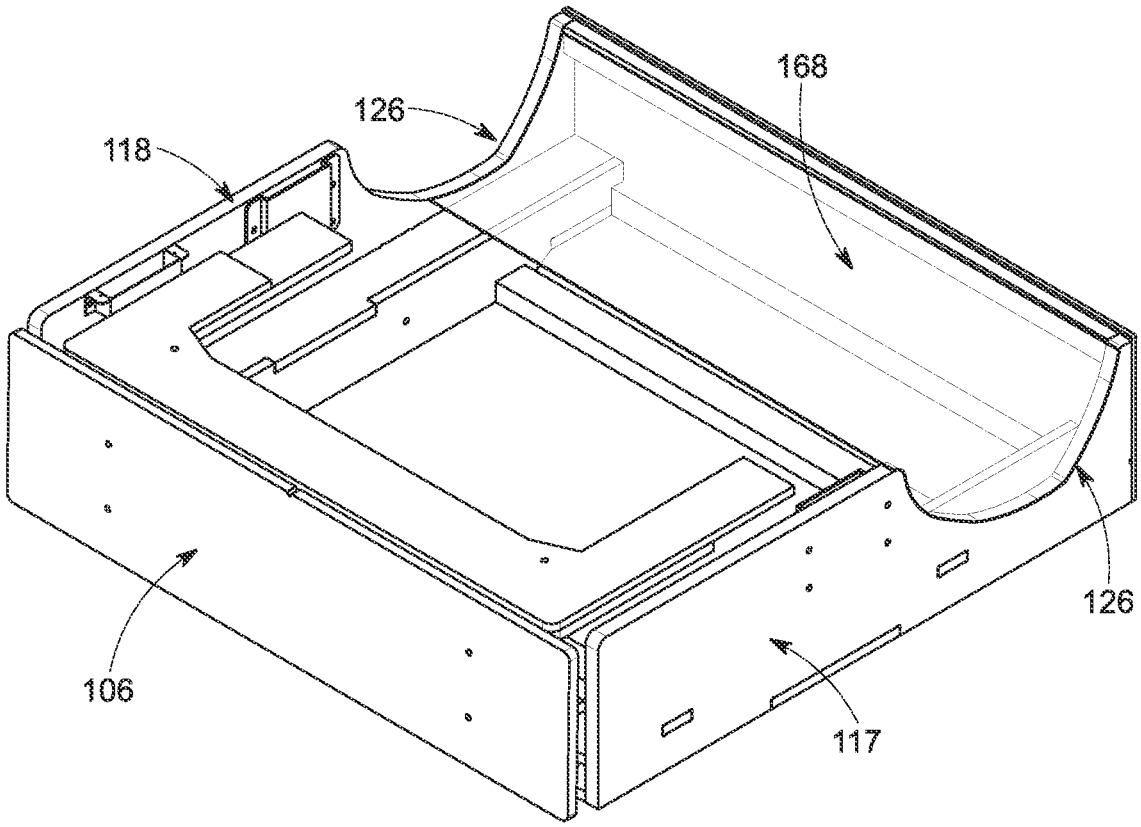
FIG. 12 is a perspective view illustrating a transverse gap of the recliner base, according to certain aspects of the present disclosure.

Referring to FIG. 12, the movement of the backrest module 108 along the recess surfaces 126 of the right and left frame members 117, 118 is further facilitated by a transverse gap 168 that extends between the recessed surfaces 126. The transverse gap 168 allows unobstructed movement of the backrest module 108 relative to the recliner base 106.

Figure 13:
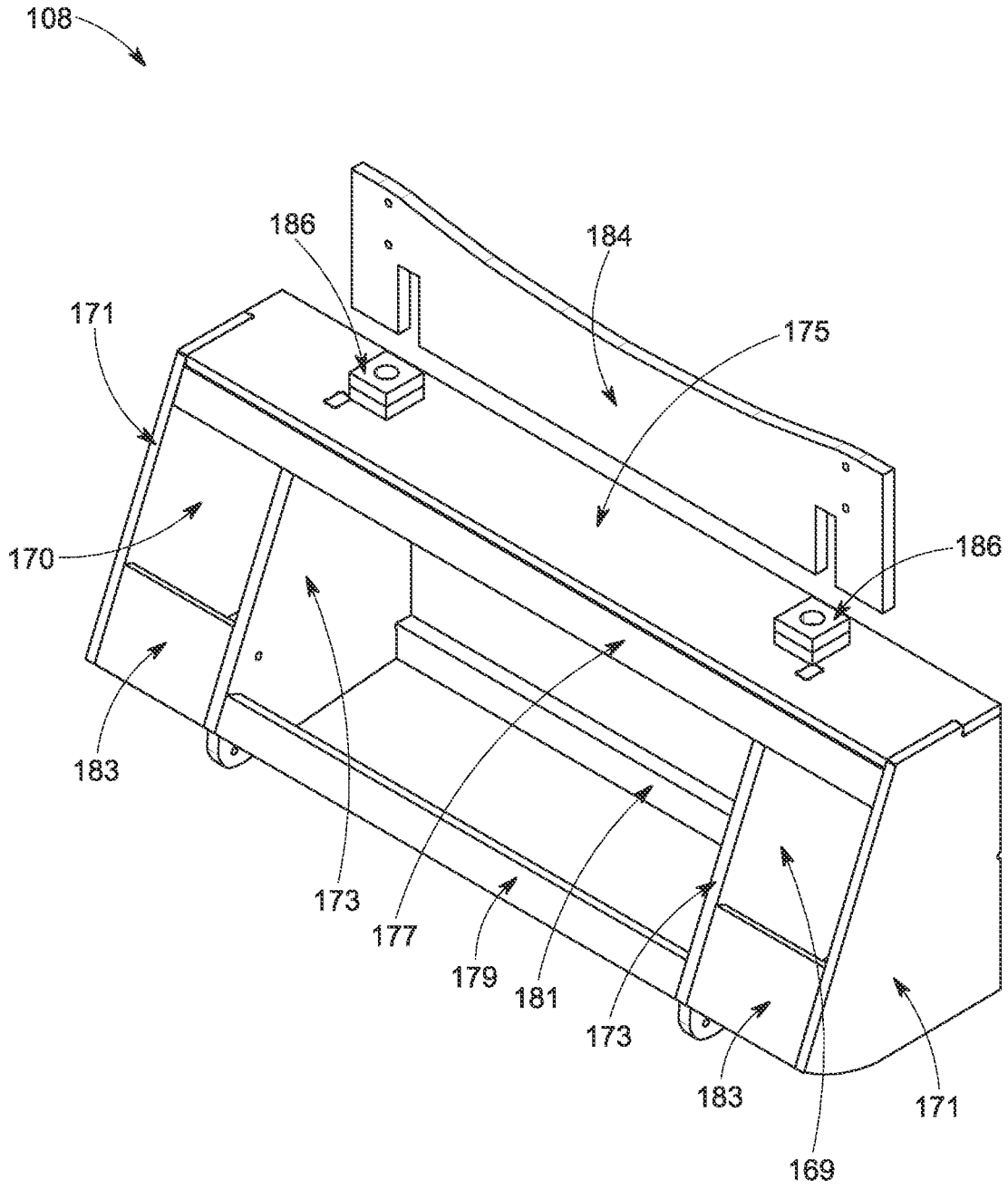
FIG. 13 is a front perspective view of the backrest module, according to certain aspects of the present disclosure.

Referring to FIG. 13, the backrest module 108 has a right backrest section 169 structurally connected with a left backrest section 170 via a plurality of connecting members. Each of the backrest sections 169, 170 has two parallel plates, which include an end plate 171 that is offset from and separated by a gap from an inner plate 173.

The connecting members include a top connecting plate 175, a front-top connecting beam 177, a front-bottom connecting beam 179, and a rear-bottom connecting beam 181. Each pair of parallel plates 171, 173 is structurally interconnected via a front connecting beam 183. The end plates 171 are connected via the front-top connecting beam 181. The inner plates 173 are connected via the front-bottom and rear-bottom connecting beams 179, 181.

The backrest module 108 further includes a headrest frame 184 that is attached to the top connecting plate 175. More specifically, the headrest frame 184 is coupled with two headrest attachments 186. The headrest frame 184 provides structural support for additional furniture components that facilitates comfort and support for the head of a user.

Figure 14:
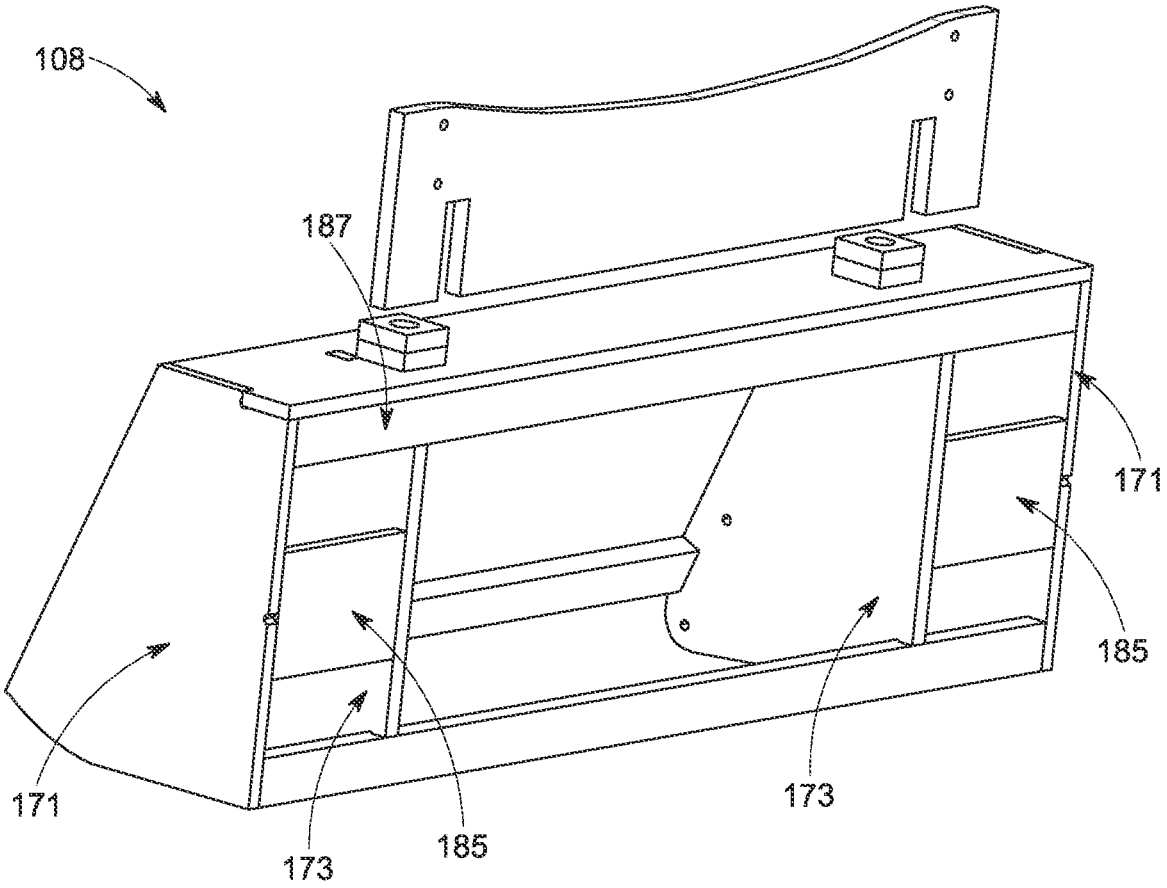
FIG. 14 is a rear perspective view of the backrest module illustrated in FIG. 13.

Referring to FIG. 14, the backrest module 108 further has a pair of rear connecting beams 185 and a rear-top connecting beam 187. Each rear connecting beam 185 further reinforces (in addition to the respective front connecting beam 183) the structural integrity between a respective pair of parallel plates 171, 173. The rear-top connecting beam 187 further reinforces (in addition to the front-top connecting beam 117) the structural integrity between the end plates 171.

Figure 15:
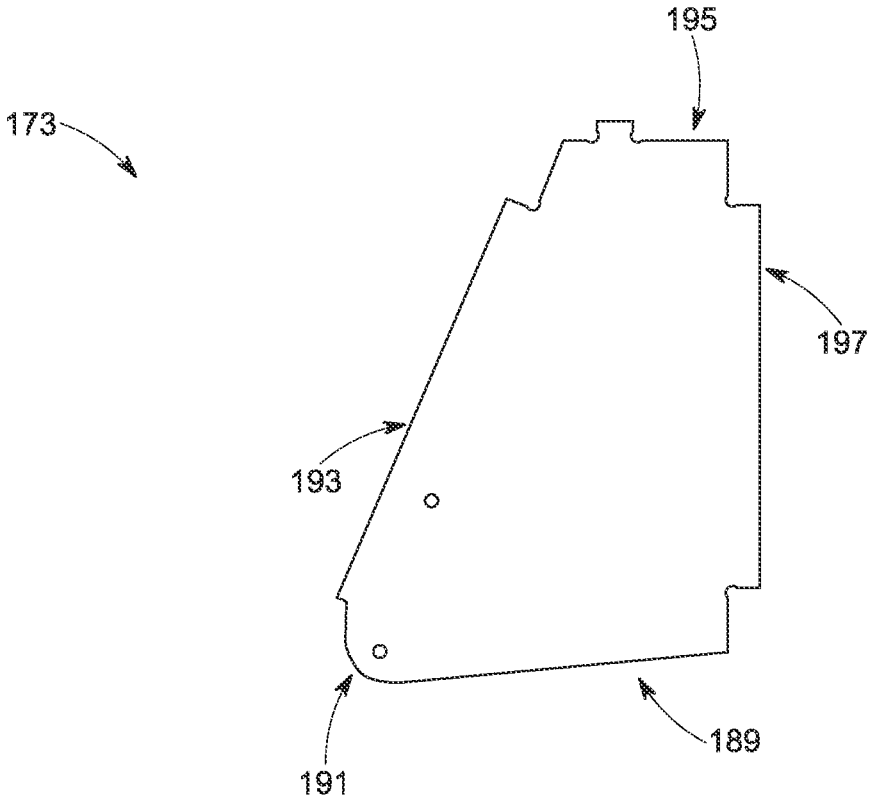
FIG. 15 is a side view of an inner plate, according to certain aspects of the present disclosure.

Referring to FIG. 15, the inner plate 173 has a bottom inclined surface 189 that is continuous with a curved surface 191. The curved surface 191 is continuous with a diagonal surface 193. The general periphery of the inner plate 173 includes a top surface 195 and a rear surface 197. The bottom inclined surface is non-parallel relative to the top surface 195.

Figure 16:
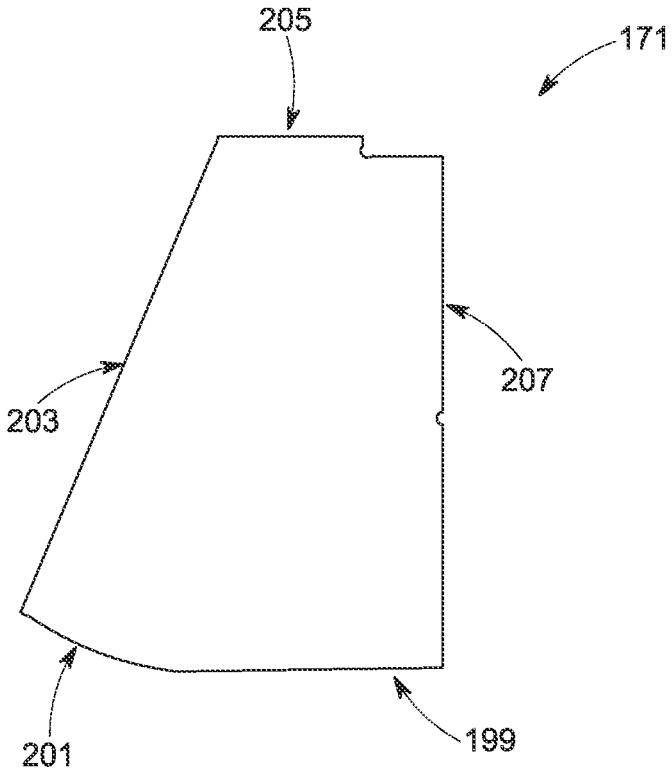
FIG. 16 is a side view of an end plate, according to certain aspects of the present disclosure.

Referring to FIG. 16, the end plate 171 has a different geometric profile than the inner plate 173. The end plate 17 has a bottom surface 199 that has a relatively less-inclined angle than the bottom inclined surface 189 of the inner plate 173. The bottom surface 199 of the end plate 171 is continuous with a curved surface 201, which is relatively less curved than the curved surface 191 of the inner plate 173. The curved surface 201 of the end plate 171 is continuous with a diagonal surface 203 of the end plate 171, which in turn is continuous with a top surface 205 of the end plate 171. The end plate 171 further includes a rear surface 207 that is continuous with the bottom surface 199. The geometric profile of the end plate 171 is designed to guide the backrest module 108 along the respective recess surface 126.

Figure 17:
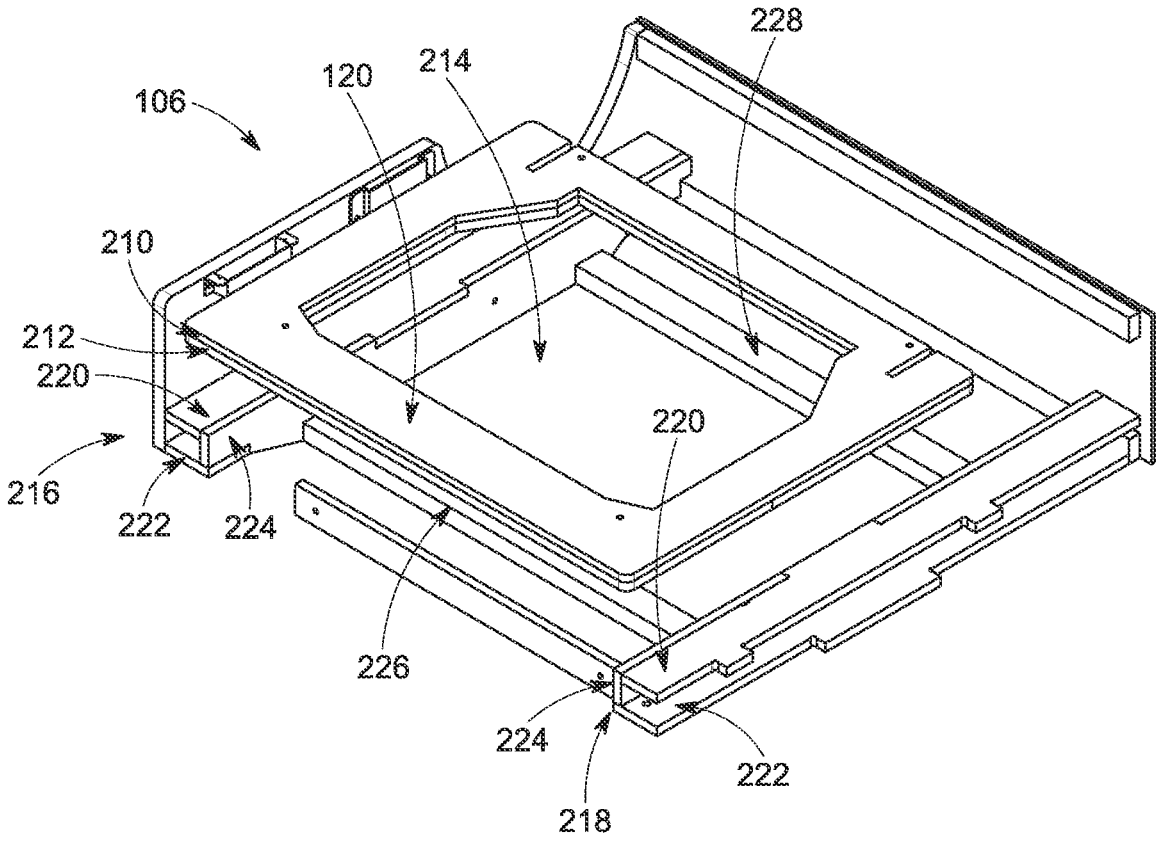
FIG. 17 is a perspective view illustrating internal components of the recliner base, according to certain aspects of the present disclosure.

Referring to FIG. 17, the recliner base 106 has additional components that render it structurally sound, with low weight and modularity capability. The top support 120 consists of two sandwiched frame layers, which include a top frame layer 210 and a bottom frame layer 212. The frame layers 210, 212 have a large internal space 214 to reduce unnecessary weight, but still provide structural integrity to the recliner base 106.

The recliner base 106 further includes a left frame structure 216 and a right frame structure 218. Each frame structure 216, 218 has a top member 220 connected to a bottom member 222 via an internal member 224. Externally, the frame structures 216, 218 are directly and respectively attached to the right and left frame members 117, 118. A pair of transverse members 226, 228 further structurally attach the internal members 224 to each other, increasing overall strength and structural integrity.

Figure 18:
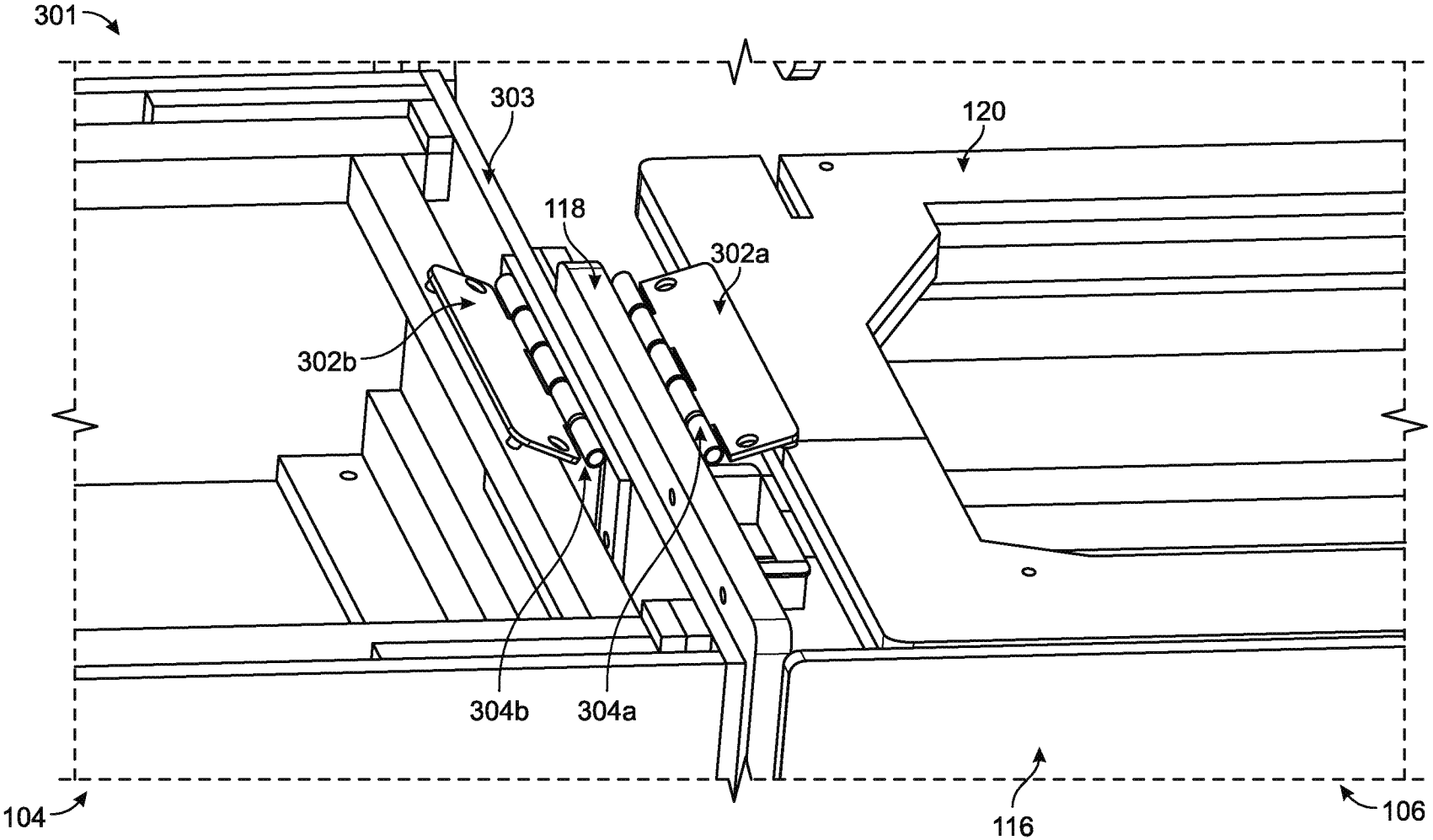
FIG. 18 is a perspective view illustrating a pivotable connector for securing modular adjacent components, according to certain aspects of the present disclosure.

Referring to FIG. 18, a pivotable connector 301 is provided. The pivotal connector 301 allows for toolless and secure engagement when attaching or securing two modular adjacent components (e.g., the modular recliner 102 of FIG. 1, the modular universal base 104 of FIG. 1, etc.). The pivotable connector 301 includes a pair of pivotable plates (i.e., a first pivotable plate 302*a* and a second pivotable plate 302*b*) that securely latch together to secure the two modular adjacent components. Each of the first and second pivotable plates 302*a*, 302*b* is illustrated in an elevated position.

In the example of FIG. 18, the modular universal base 104 is adjacent to the recliner base 106. The modular universal base 104 is to be secured to the recliner base 106. The pivotable connector 301 includes vertical mounting plates (i.e., a first vertical mounting plate 304*a* and a second vertical mounting plate 304*b*) which are permanently fixed to the interior surfaces of the frames of the modular adjacent components (i.e., the left frame member 118 of the recliner base 106 and a right outer frame member 303 of the modular universal base 104). The first and second pivotable plates 302*a*, 302*b* are hingeably connected to the first and second vertical mounting plates 304*a*, 304*b*, respectively. In some implementations, a butt hinge provides the hinge connection between a pivotable plate (e.g., the first pivotable plate 302*a*) and a vertical mounting plate (e.g., the first vertical mounting plate 304*a*). The first and second pivotable plates 302*a*, 302*b* pivot or rotate about their respective hinge connections relative to the first and second vertical mounting plates 304*a*, 304*b*.

In some implementations, each of the first and second pivotable plates 302*a*, 302*b* has identical dimensions (i.e., thickness, width, and height are equal). In some implementations, each of the first and second pivotable plates 302*a*, 302*b* has a rectangular or square shape. In some implementations, the rectangular or square shape includes rounded corners.

Figure 19A:
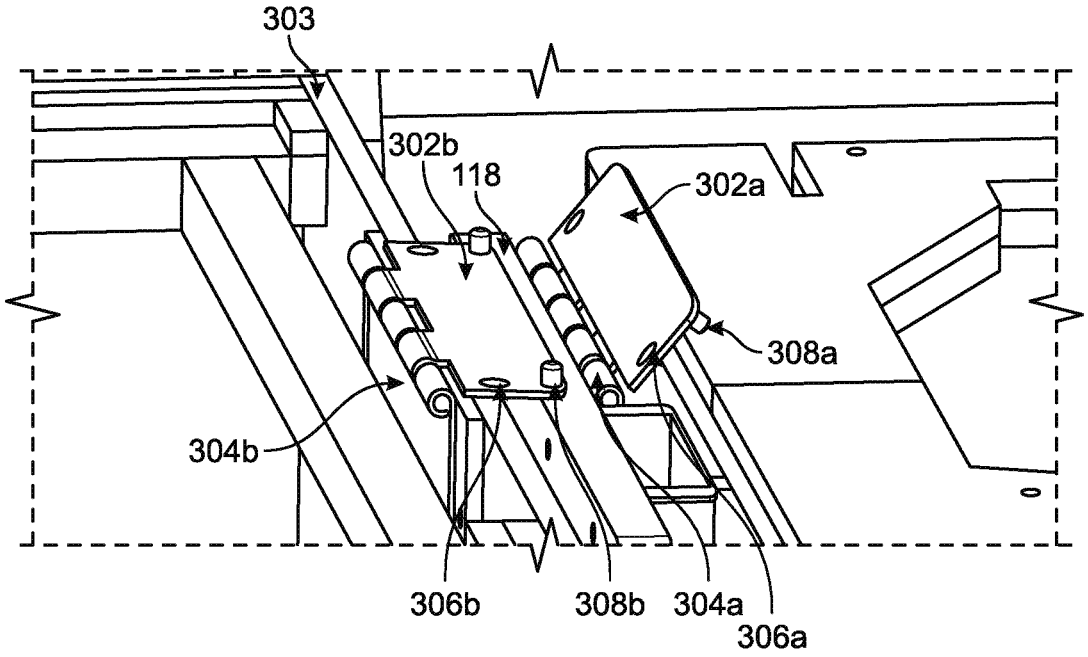
FIG. 19A is a perspective view illustrating one pivotable plate of the pivotable connector of FIG. 18 positioned in a coupling position, according to certain aspects of the present disclosure.
Figure 19B:
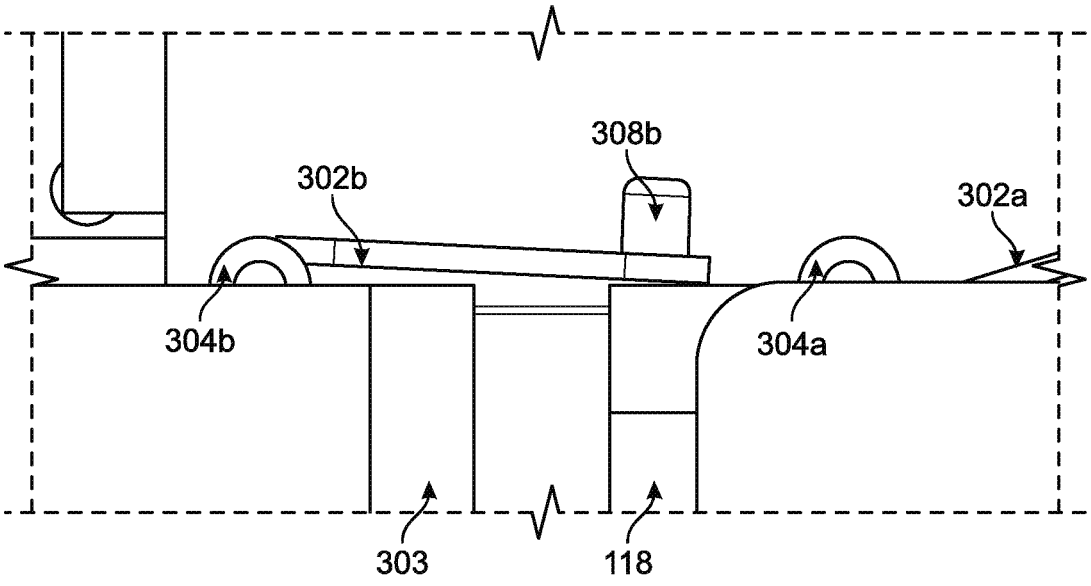
FIG. 19B is a side view of the pivotable plate of FIG. 19A.

Referring to FIGS. 19A and 19B, the second pivotable plate 302*b* is positioned in a coupling position while the first pivotable plate 302*a* remains in the elevated position. In some implementations, when in the coupling position, the second pivotable plate 302*b* extends across a top edge of the right outer frame member 303 to rest atop a top edge of the left frame member 118. In some implementations, the second pivotable plate 302*b* is provided at an angle such that the second pivotable plate 302*b* rests atop the top edge of the left frame member 118 but does not make contact with the top edge of the right outer frame member 303. In the coupling position, the separation between the second pivotable plate 302*b* and the top edge of the right outer frame member 303 is adjustable based on the position of the hinge connection between the second pivotable plate 302*b* and the second vertical pivotable plate 304*b*.

The first and second pivotable plates 302*a*, 302*b* include one or more coupling holes 306*a*, 306*b*, respectively. The first and second pivotable plates 302*a*, 302*b* further include one or more protrusions 308*a*, 308*b*, respectively. The one or more protrusions 308*a* are configured to couple with the one or more coupling holes 306*b*. Similarly, the one or more protrusions 308*b* are configured to couple with the one or more coupling holes 306*a*. In some implementations, as provided in FIGS. 18 and 19A, each of the first and second pivotable plates 302*a*, 302*b* includes two protrusions 308*a*, 308*b*, respectively, and two coupling holes 306*a*, 306*b*, respectively. In some implementations, the two protrusions 308*a*, 308*b* can be provided along a long edge of the first and second pivotable plates 302*a*, 302*b*, respectively. In some implementations, the two protrusions 308*a*, 308*b* can be provided at corners of the first and second pivotable plates 302*a*, 302*b*, respectively.

Similarly, the two coupling holes 306*a*, 306*b* can be provided along a long edge of the first and second pivotable plates 302*a*, 302*b*, respectively, and/or at corners of the first and second pivotable plates 302*a*, 302*b*, respectively. Locations of the two protrusions 308*a*, 308*b* and the two coupling holes 306*a*, 306*b* are provided in one configuration in FIGS. 18, 19A, and 19B only as an example. In some implementations, the two coupling holes 306*a*, 306*b* are provided closer to the hinge connections to facilitate the two coupling holes 306*a*, 306*b* clearing a height of the two protrusions 308*a*, 308*b*. For example, in the coupling position, having the two protrusions 308*b* resting on the top edge of the left frame member 118 and having the second pivotable plate 302*b* at an angle (FIG. 19B) facilitates the two coupling holes 306*a* clearing a top of the two protrusions 308*b* to engage the two protrusions 308*b*.

Figure 20A:
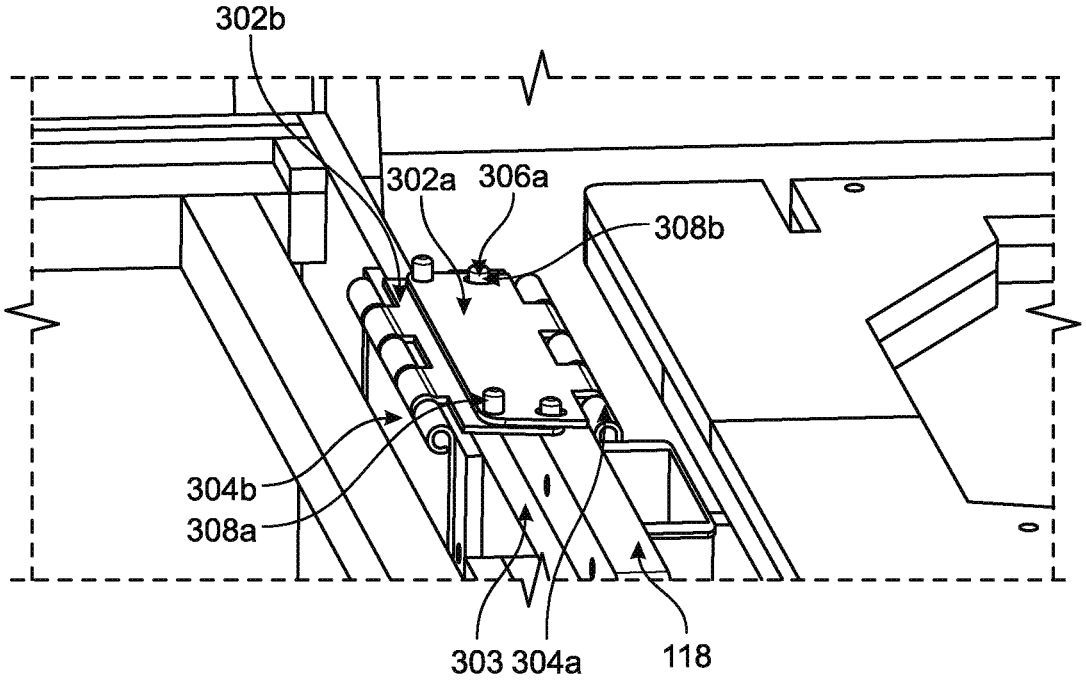
FIG. 20A is a perspective view illustrating both pivotable plates of the pivotable connector of FIG. 18 positioned in the coupling position, according to certain aspects of the present disclosure.
Figure 20B:
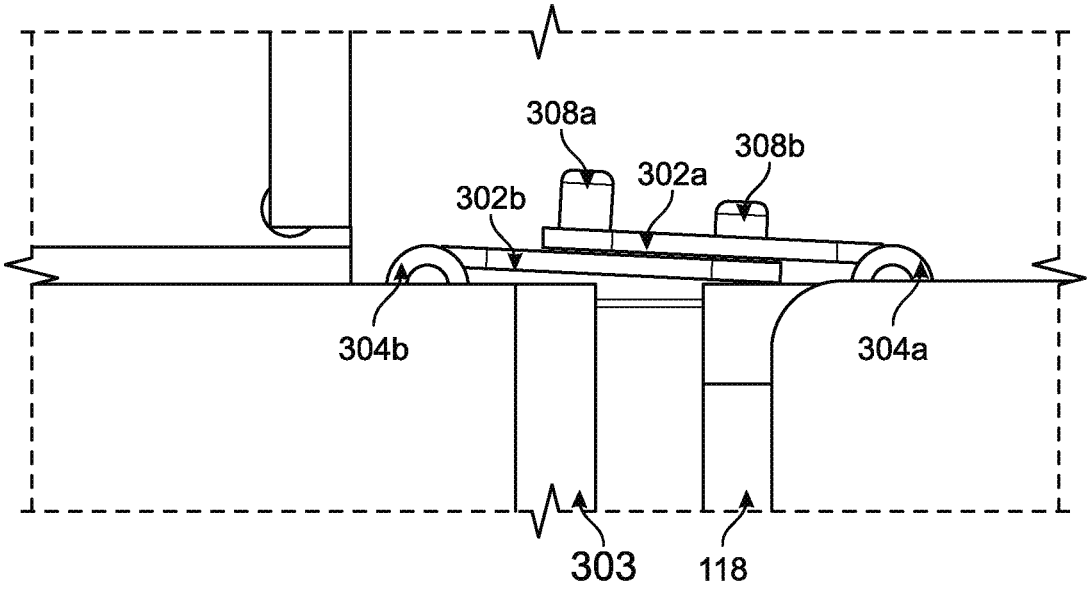
FIG. 20B is a side view of the pivotable plates of FIG. 20A.

Referring to FIGS. 20A and 20B, both the second pivotable plate 302*b* and the first pivotable plate 302*a* are positioned in the coupling position, with both the first and second pivotable plates 302*a*, 302*b* partially overlapping each other. Although in FIGS. 20A and 20B, the second pivotable plate 302*b* is underneath the first pivotable plate 302*a*, in other configurations, the first pivotable plate 302*a* can be placed in the coupling position before the second pivotable plate 302*b* such that the first pivotable plate 302*a* is underneath the second pivotable plate 302*b*. This design of the first and the second pivotable plates 302*a*, 302*b* allow flexibility in coupling the modular adjacent components. The two coupling holes 306*a* are positioned to match the two protrusions 308*b* when in the coupling position. Similarly, the two coupling holes 306*b* are positioned to match the two protrusions 308*a* when in the coupling position. In the configuration of FIGS. 18-20B, due to the positioning of the protrusions and coupling holes, either the two protrusions 308*b* are engaged by the coupling holes 306*a* or the two protrusions 308*a* are engaged by the coupling holes 306*b*, but not both. Other configurations that rearrange the protrusions and coupling holes can result in both protrusions 308*a*, 308*b* always engaged in both coupling holes 306*b*, 306*a*.

In the configuration of FIGS. 18-20B, the vertical mounting plates 304*a*, 304*b* are attached to the interior surfaces of the frames of the modular adjacent components. In some implementations, one or more of these vertical mounting plates 304*a*, 304*b* can be attached to an exterior of the frame of the modular adjacent components. Although the positioning of the coupling holes and protrusions are similar for both the first and second pivotable plates 302*a*, 302*b*, in some implementations, one of the pivotable plates can include only protrusions while the other one of the pivotable plates can include only coupling holes for engaging the protrusions. In such a configuration, aspect ratio of the pivotable plates can differ such that the pivotable plates having only protrusions have a larger surface area compared to pivotable plates having only holes.

Figure 21A:
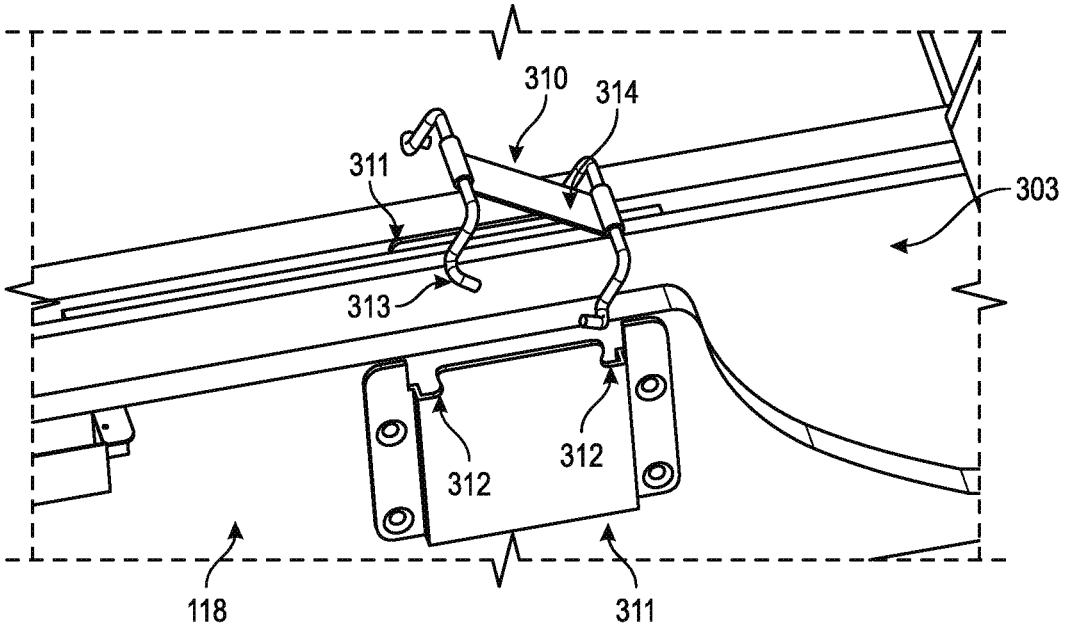
FIG. 21A is a perspective view illustrating a snapping connector piece for securing modular adjacent components, according to certain aspects of the present disclosure.
Figure 21B:
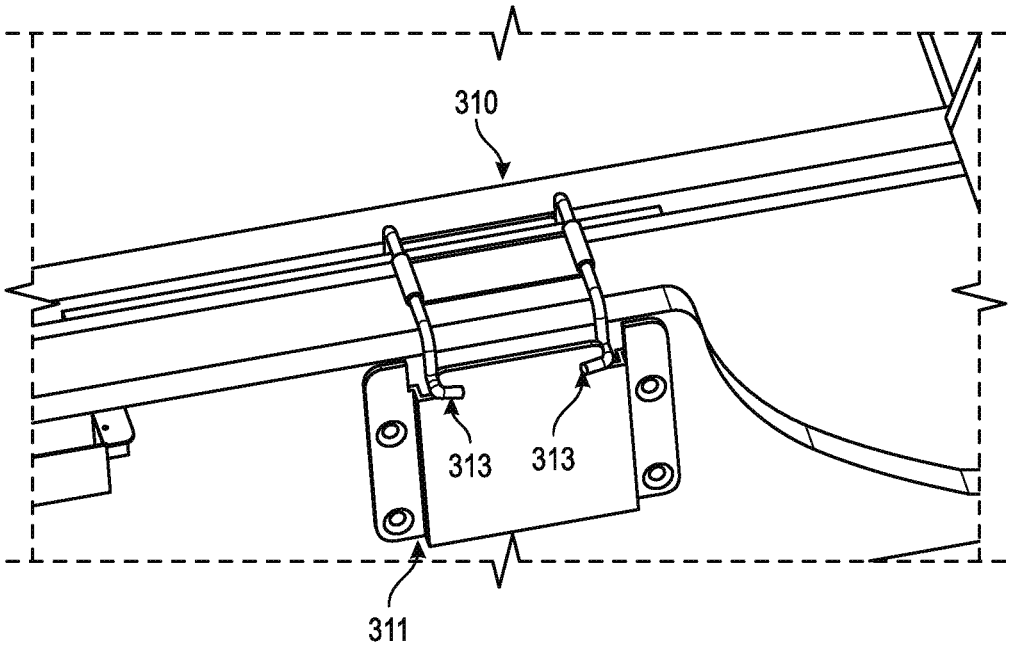
FIG. 21B is a perspective view illustrating the snapping connector piece of FIG. 21A positioned between the modular adjacent components, according to certain aspects of the present disclosure.

Referring to FIG. 21A, a snapping connector piece 310 for securing modular adjacent components is provided, according to certain aspects of the present disclosure. The snapping connector piece 310 is coupled with modified receiving connectors 311 for securing the modular adjacent components. Modified receiving connectors 311 are similar to the receiving connector 134 of FIGS. 5A and 5B. The modified receiving connectors 311 are coupled to the inner surfaces of the frames of the modular adjacent components (e.g., the left frame member 118 of the recliner base 106 and the right outer frame member 303 of the modular universal base 104). The snapping connector piece 310 couples to both of the modified receiving connectors as provided in FIG. 21B to secure the modular adjacent components. The modified receiving connector 311 includes recessed portions 312 for receiving pins 310 of the snapping connector piece 310.

The snapping connector piece 310 has a central plate 314 with the pins 313 coupled to the central plate 314. In some implementations, the pins 313 are bent or hook-shaped to conform to a shape of the recess 312. The conformity allows for latching to the corresponding modified receiving connector 311. To install the snapping connector 310, the central plate 314 can be pressed downward so that one pair of pins 313 latch to the modified receiving connector 311 on the left frame member 118 while the other pair of pins 313 latch to the modified receiving connector 311 on the right outer frame member 303. When installation is complete, each pair of pins 313 is lodged into the front and back recesses 312 of the corresponding modified receiving connector 311. Tension provided by the rigid structure of the snapping connector piece 310 pinch each pair of ins together to prevent removal of the pins 313 from the recesses 312.

Figure 23:
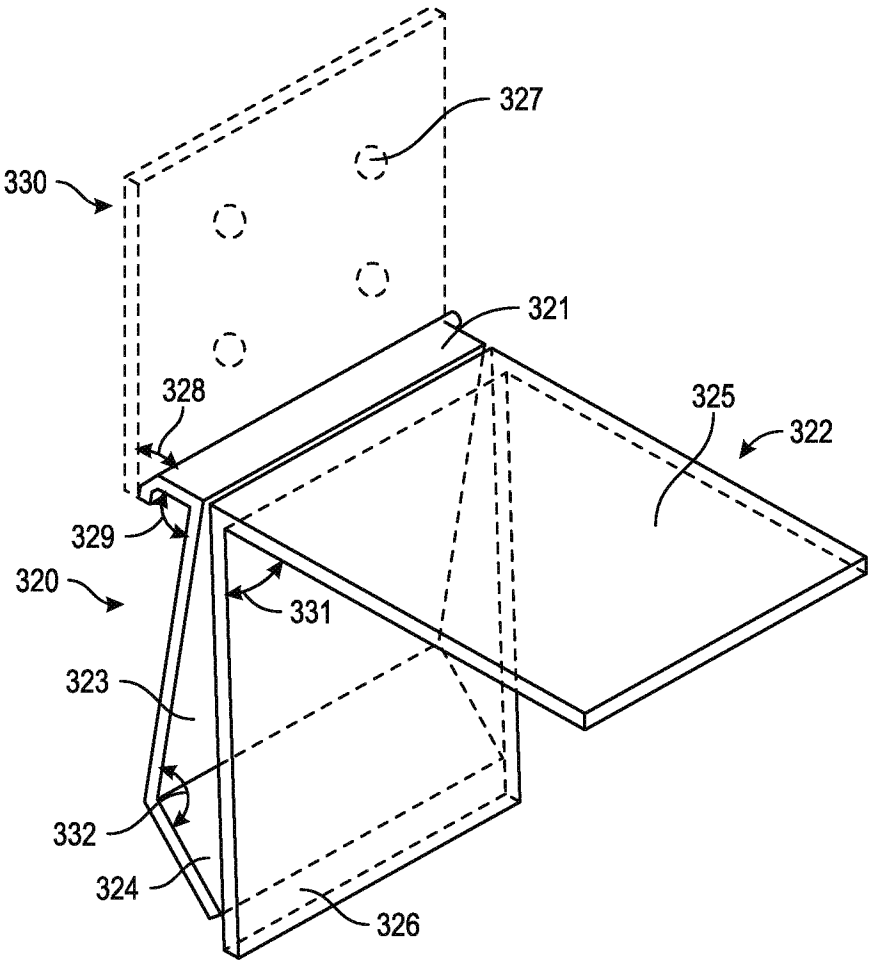
FIG. 23 is a perspective view illustrating the combination of the Z-Shaped connector and the L-Shaped connector of FIG. 22.
Figure 22:
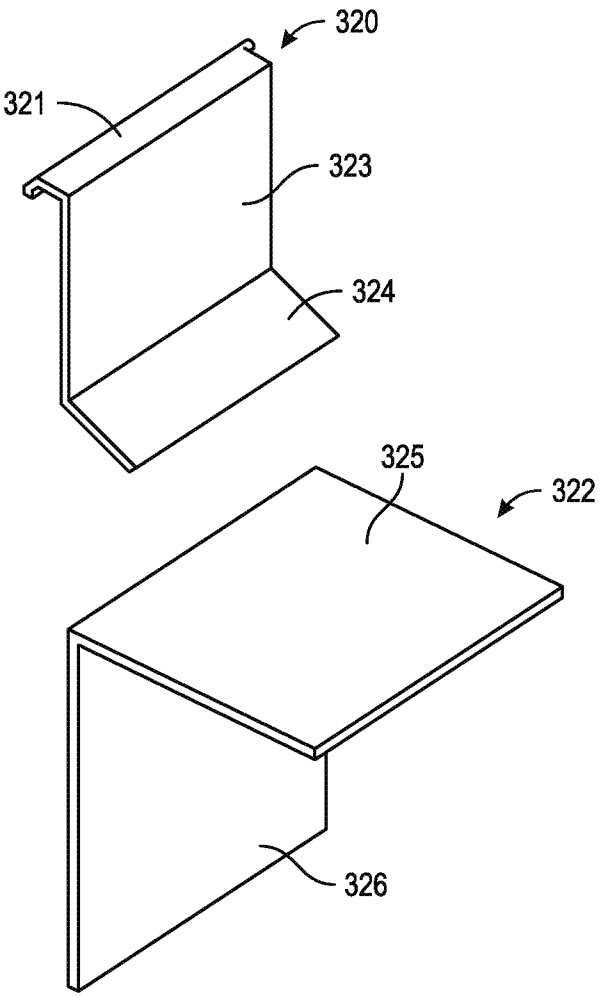
FIG. 22 is a perspective view illustrating a Z-Shaped connector and an L-Shaped connector, according to aspects of the present disclosure.
Figure 24A:
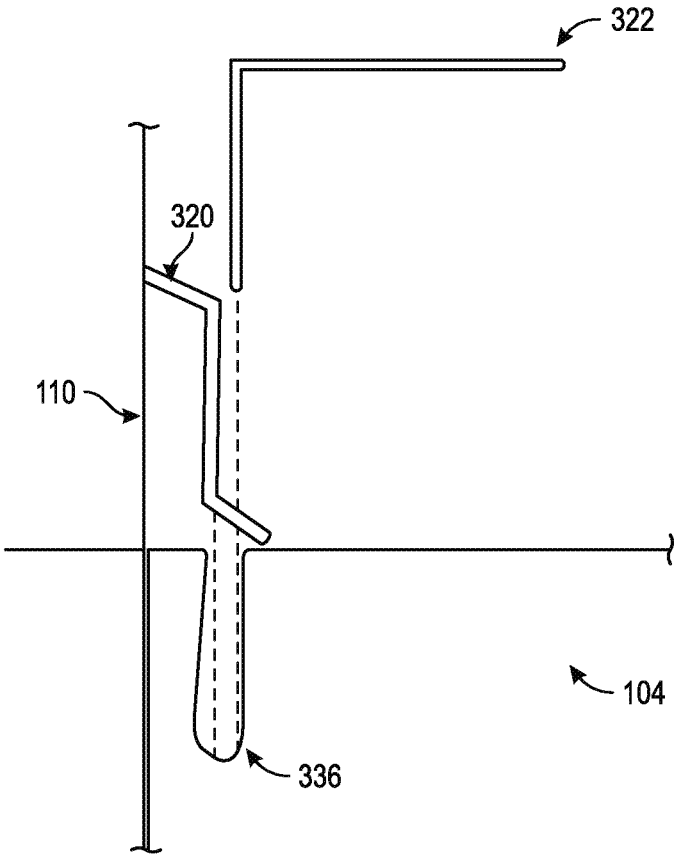
FIG. 24A illustrates positioning of the Z-Shaped connector and the L-Shaped connector when uncoupled, according to aspects of the present disclosure.
Figure 24B:
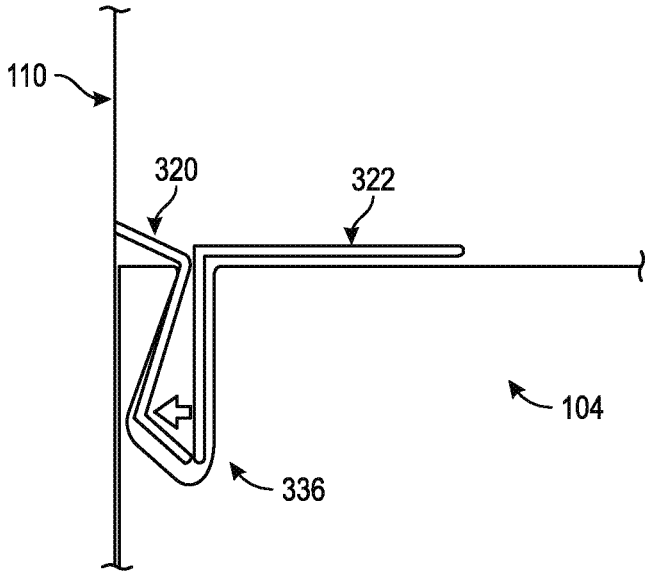
FIG. 24B illustrates positioning of the Z-Shaped connector and the L-Shaped connector when coupled to the modular furniture assembly.

Referring to FIGS. 22 and 23, a Z-Shaped connector 320 and an L-Shaped connector 322 is provided, according to certain aspects of the present disclosure. The Z-Shaped connector 320 includes three portions (i.e., a first portion 321, a second portion 323, and a third portion 324). The first portion 321 and the second portion 323 are connected to each other at a first angle 329. The second portion 323 is connected to the third portion 324 at a second angle 332. The first portion 321 can be attached to a component of the modular furniture assembly 100 (e.g., attached to the armrest module 110 of FIG. 2 via a mounting panel 330 having mounting holes 327). The second portion 323 and the third portion 324 are inserted into a receptacle or a cavity provided in the modular universal base 104. This is shown in FIGS. 24A and 24B. The Z-Shaped connector 320 is malleable and can be locked in the receptacle or cavity using the L-Shaped connector 322. The L-Shaped connector 322 includes a first portion 326 and a second portion 325 provided at an angle 331. The first portion 326 is insertable into the receptacle to lock the Z-Shaped connector 320 in place.

Figure 25:
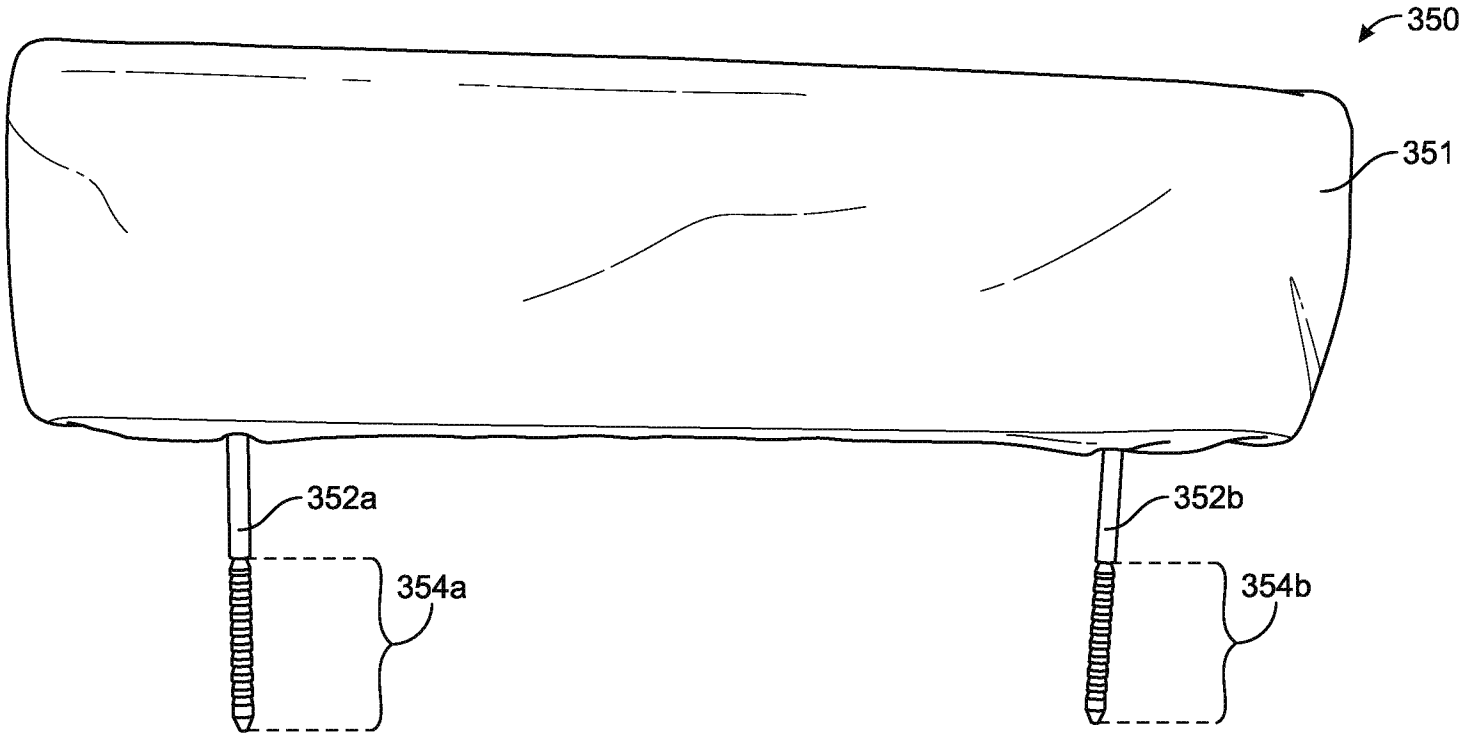
FIG. 25 illustrates a headrest, according to aspects of the present disclosure.
Figure 26:
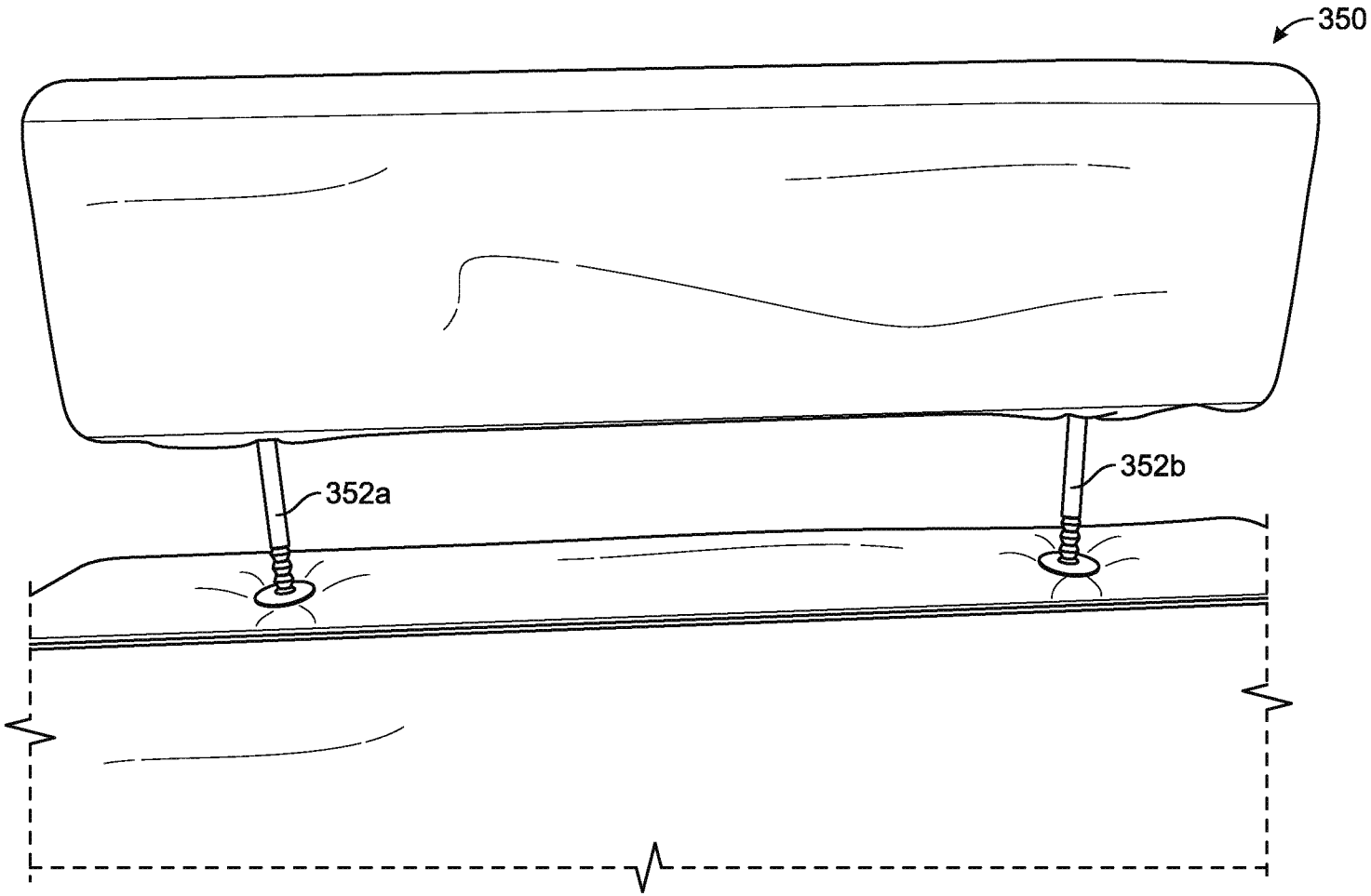
FIG. 26 illustrates the headrest of FIG. 25 in a backrest, according to aspects of the present disclosure.

Referring to FIG. 25, a headrest 350 is provided. The headrest 350 includes a cushioned portion 351 and one or more insertion poles 352*a*, 352*b*. Each of the insertion poles 352*a*, 352*b* includes adjustable settings 354*a*, 354*b*. The adjustable settings 354*a*, 354*b* include smaller diameter portions separated by larger diameter portions of the insertion poles 352*a*, 352*b*. The headrest 350 is insertable in a backrest as provided in FIG. 26. A user can push the headrest 350 into the backrest or pull the headrest 350 from the backrest to adjust a height of the cushioned portion 351. The adjustable settings 354*a*, 354*b* lock in the smaller diameter portions.

Figure 27:
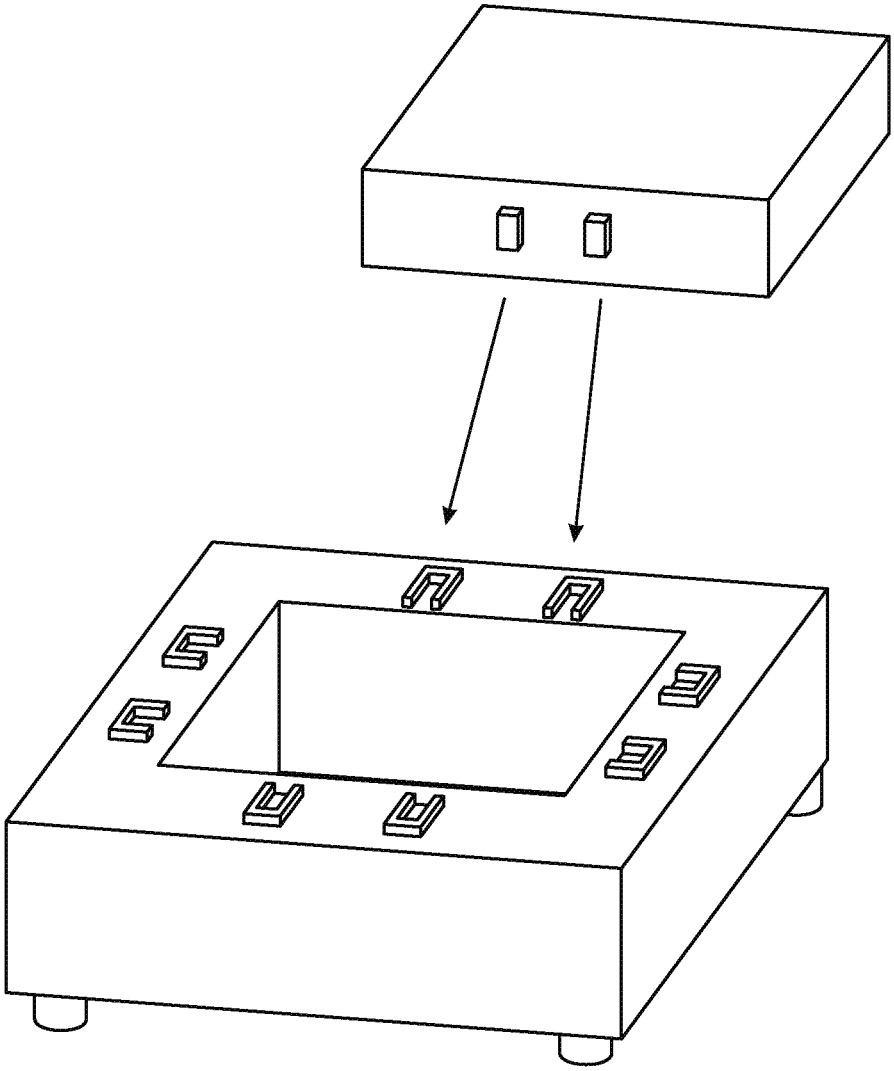
FIG. 27 illustrates U-Shaped connectors on a second modular universal base and protrusions on a modular component, according to aspects of the present disclosure.

Referring to FIG. 27, a U-Shaped connector can be provided on surface of a first modular component. The U-Shaped connector provides slots being adaptable for receiving a plurality of protrusions on surface(s) of a second modular component. For example, the U-Shaped connector can be provided on surface of a modular universal base 104. Armrest modules and backrest modules can have protrusions that fit in the slots of the U-Shaped connector to attach the backrest modules and/or the armrest modules to the modular universal base 104.

Numerous references are made herein to many embodiments, and in any of various other documents incorporated herein by reference. Those skilled in the art will recognize that many changes may be made to the described embodiments without departing from the spirit and scope of the present disclosure. Furthermore, those skilled in the art will also recognize that certain embodiments described for one device or system or method can be readily, or with slight modification, be included in the embodiments described for another device or system or method, without departing from the spirit and scope of the present disclosure.

By way of example, the following alternative embodiments are illustrative examples of the present disclosure.

Alternative Embodiment A1. A modular furniture assembly comprising: a modular universal base; a modular recliner having a recliner base, the recliner base having a plurality of frames interconnected and mechanically attached to each other, the plurality of frames including a front frame member, a right frame member, a left frame member, and a rear frame member, each of the left and right frame members having a recessed surface that forms a transverse gap within the recliner base; and a connector attached directly to the modular recliner and the modular universal base, the connector coupling the modular recliner and the modular universal base achieving a secure, toolless modular attachment between the modular universal base and the modular recliner.

Alternative Embodiment A2. The modular furniture assembly of Alternative Embodiment A1, wherein the connector is a pivotable connector, the pivotable connector including a first vertical mounting plate attached to the modular universal base and a second vertical mounting plate attached to the modular recliner, the pivotable connector further including a first pivotable plate coupled to the first vertical mounting plate and a second pivotable plate coupled to the second vertical mounting plate.

Alternative Embodiment A3. The modular furniture assembly of Alternative Embodiment A2, wherein the first pivotable plate is hingeably connected to the first vertical mounting plate, and the second pivotable plate is hingeably connected to the second vertical mounting plate.

Alternative Embodiment A4. The modular furniture assembly of Alternative Embodiment A2, wherein the first pivotable plate includes coupling holes for coupling to protrusions on the second pivotable plate.

Alternative Embodiment A5. The modular furniture assembly of Alternative Embodiment A2, wherein the second pivotable plate includes coupling holes for coupling to protrusions on the first pivotable plate.

Alternative Embodiment A6. The modular furniture assembly of Alternative Embodiment A5, wherein when in a coupling position, the protrusions on the first pivotable plate rest on one of the plurality of frames of the recliner.

Alternative Embodiment A7. The modular furniture assembly of Alternative Embodiment A1, wherein the connector is a snapping connector piece, the snapping connector piece being coupled to modified receiving connectors attached to the modular universal base and the modular recliner.

Alternative Embodiment A8. The modular furniture assembly of Alternative Embodiment A7, wherein the snapping connector piece includes pins that couple to recesses in the modified receiving connectors.

Alternative Embodiment B1. A modular furniture assembly comprising: a modular universal base; an armrest module modularly coupled to one side of the modular universal base, the armrest module having an armrest member configured to receive a user arm when a user is in a seated position, a stepped member configured to receive a user head when the user is in a lying down position, the stepped member being generally horizontal to and lower than the armrest member, and a base horizontal member generally parallel to and lower than the stepped member, and a base vertical plate covering an empty internal space between the base horizontal member and a bottom end of the armrest module; a Z-Shaped connector attached to the armrest module and configured to be received within a cavity in the modular universal base; and an L-Shaped connector configured to lock the Z-Shaped connector in the cavity.

While various embodiments of the present disclosure have been described above, it should be understood that they have been presented by way of example only, and not limitation. Numerous changes to the disclosed embodiments can be made in accordance with the disclosure herein, without departing from the spirit or scope of the disclosure. Thus, the breadth and scope of the present disclosure should not be limited by any of the above described embodiments. Rather, the scope of the disclosure should be defined in accordance with the following claims and their equivalents.

What is claimed is:

1. A modular furniture assembly comprising:

a modular universal base;

an armrest module modularly coupled to one side of the modular universal base, the armrest module having an armrest member configured to receive a user arm when a user is in a seated position, a stepped member configured to receive a user head when the user is in a lying down position, the stepped member being generally horizontal to and lower than the armrest member, and a base horizontal member generally parallel to and lower than the stepped member, and a base vertical plate covering an empty internal space between the base horizontal member and a bottom end of the armrest module; and a modular recliner coupled to another side of the modular universal base, the modular recliner having a recliner base having a plurality of frames interconnected and mechanically attached to each other, the plurality of frames including a front frame member, a right frame member, a left frame member, and a rear frame member, each of the left and right frame members having a recessed surface that forms a transverse gap within the recliner base, and a top support having a flat top surface aligned with top edges of the plurality of frames, the top support having at least two sandwiched frame layers including a top frame layer and a bottom frame layer, the at least two sandwiched frame layers having an internal space for reducing weight of the modular recliner, and a backrest module having two backrest sections, each of the backrest sections having an end plate and an inner plate, each end plate having a bottom surface at an inclined angle that is configured to move along a respective recessed surface, the end plate being structurally connected to the inner plate via a plurality of first connecting beams, the inner plates being structurally connected to each other via a plurality of second connecting beams.

2. The modular furniture assembly of claim 1, wherein the recessed surface is near the frame rear member.

3. The modular furniture assembly of claim 1, wherein the recessed surface has a generally arcuate shape.

4. The modular furniture assembly of claim 1, wherein the recessed surface extends inward starting at a top edge of the right frame member.

5. The modular furniture assembly of claim 4, wherein the recessed surface extends between the top edge of the right frame member and partially towards a lower edge of the right frame member.

6. The modular furniture assembly of claim 1, wherein the recliner base further has a pair of frame structures that includes a left frame structure and a right frame structure, the left frame structure being directly attached to the left frame member and the right frame structure being directly attached to the right frame member.

7. The modular furniture assembly of claim 6, wherein each frame structure of the pair of frame structures having a top member connected to a bottom member via an internal member.

8. The modular furniture assembly of claim 7, wherein a pair of transverse members attach the internal member of each structure to the other internal member.

9. The modular furniture assembly of claim 1, further comprising a connector attached directly to the modular recliner and the modular universal base, the connector coupling the modular recliner and the modular universal base achieving a secure, toolless modular attachment between the modular universal base and the modular recliner.

10. The modular furniture assembly of claim 9, wherein the connector is a pivotable connector, the pivotable connector including a first vertical mounting plate attached to the modular universal base and a second vertical mounting plate attached to the modular recliner, the pivotable connector further including a first pivotable plate coupled to the first vertical mounting plate and a second pivotable plate coupled to the second vertical mounting plate.

11. A modular furniture assembly comprising:

an armrest module having an armrest member configured to receive a user arm when a user is in a seated position, and a stepped member configured to receive a user head when the user is in a lying down position, the stepped member being generally horizontal to and lower than the armrest member;

an insertion connector attached directly to the armrest module, the insertion connector having bent end;

a modular recliner having a recliner base having a plurality of frames interconnected and mechanically attached to each other, the plurality of frames including a front frame member, a right frame member, a left frame member, and a rear frame member, each of the left and right frame members having a recessed surface that forms a transverse gap within the recliner base, and a top support having a flat top surface aligned with top edges of the plurality of frames, the top support having at least two sandwiched frame layers including a top frame layer and a bottom frame layer, and a backrest module having two backrest sections, each of the backrest sections having an end plate and an inner plate, each end plate having a bottom surface at an inclined angle that is configured to move along a respective recessed surface; and a receiving connector attached directly to the modular recliner, the receiving connector having a mounting space in which the bent end of the insertion connector is received, mounting the receiving connector with the insertion connector and achieving a secure, toolless modular attachment between the armrest module and the modular recliner.

12. The modular furniture assembly of claim 11, wherein the insertion connector has an insertion plate that is connected to an attachment plate via a connecting side, the bent end being a free end extending from the insertion plate.

13. The modular furniture assembly of claim 12, wherein the bent end is angled away from a plane of the attachment plate.

14. The modular furniture assembly of claim 12, wherein the insertion plate is offset from and parallel to the attachment plate.

15. The modular furniture assembly of claim 12, wherein the offset between the insertion plate and the attachment plate is based on a length dimension of the connecting side.

16. The modular furniture assembly of claim 11, wherein the receiving connector has two sides connected via a retaining side, each of the two sides having a mounting surface that is directly attached to the modular recliner.

17. The modular furniture assembly of claim 16, wherein the retaining side has a c-shaped profile relative to the mounting surface of the two sides.

18. The modular furniture assembly of claim 16, wherein each of the two sides has two connector attachment holes.

19. The modular furniture assembly of claim 16, wherein the receiving connector is attached directly to either the left frame member or the right frame member, the c-shaped profile forming the mounting space between the retaining side and the one of either the left frame member or the right frame member to which the receiving connector is attached.

20. The modular furniture assembly of claim 11, wherein the armrest module further has a base vertical plate positioned generally perpendicular to and below the stepped member, the insertion connector being attached directly to the base horizontal member.

* * * * *